US009758851B2

(12) United States Patent
Katsuragi et al.

(10) Patent No.: US 9,758,851 B2
(45) Date of Patent: Sep. 12, 2017

(54) HEAT-RESISTANT, CAST FERRITIC STEEL HAVING EXCELLENT MACHINABILITY AND EXHAUST MEMBER MADE THEREOF

(71) Applicant: HITACHI METALS, LTD., Tokyo (JP)

(72) Inventors: Susumu Katsuragi, Moka (JP); Masahide Kawabata, Moka (JP); Tomonori Sakuta, Miyako-gun (JP); Kana Morishita, Matsue (JP); Kenichi Inoue, Matsue (JP)

(73) Assignee: HITACHI METALS, LTD., Tokyo (JP)

( * ) Notice: Subject to any disclaimer, the term of this patent is extended or adjusted under 35 U.S.C. 154(b) by 370 days.

(21) Appl. No.: 14/434,606

(22) PCT Filed: Oct. 4, 2013

(86) PCT No.: PCT/JP2013/077048
§ 371 (c)(1),
(2) Date: Apr. 9, 2015

(87) PCT Pub. No.: WO2014/057875
PCT Pub. Date: Apr. 17, 2014

(65) Prior Publication Data

US 2015/0275344 A1 Oct. 1, 2015

(30) Foreign Application Priority Data

Oct. 10, 2012 (JP) ..... 2012-224740

(51) Int. Cl.
*C22C 38/60* (2006.01)
*C22C 38/00* (2006.01)
(Continued)

(52) U.S. Cl.
CPC ..... *C22C 38/60* (2013.01); *C22C 38/00* (2013.01); *C22C 38/001* (2013.01); *C22C 38/02* (2013.01);
(Continued)

(58) Field of Classification Search
CPC ..... C22C 38/00; C22C 38/001; C22C 38/02; C22C 38/04; C22C 38/06; C22C 38/44;
(Continued)

(56) References Cited

U.S. PATENT DOCUMENTS 5,254,307 A * 10/1993 Hasegawa ..... C22C 38/00 420/66
5,340,414 A * 8/1994 Asai ..... C22C 38/32 420/64
(Continued)

FOREIGN PATENT DOCUMENTS

CN 1119878 A 4/1996
CN 102086498 A 6/2011
(Continued)

OTHER PUBLICATIONS

Communication dated Feb. 3, 2016 from the State Intellectual Property Office of the P.R.C. issued in corresponding Chinese Application No. 201380052871.1.
(Continued)

*Primary Examiner* — Helene Klemanski
(74) *Attorney, Agent, or Firm* — Sughrue Mion, PLLC

(57) ABSTRACT

A heat-resistant, cast ferritic steel having excellent machinability comprising by mass 0.32-0.48% of C, 0.85% or less of Si, 0.1-2% of Mn, 1.5% or less of Ni, 16-23% of Cr, 3.2-5% of Nb, Nb/C being 9-11.5, 0.15% or less of N, 0.05-0.2% of S, and 0.01-0.08% of Al, the balance being Fe and inevitable impurities, and an exhaust member made thereof.

5 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/58*** | (2006.01) |
| ***C21D 6/00*** | (2006.01) |
| ***F01N 13/16*** | (2010.01) |

(52) U.S. Cl.
CPC ..... *C22C 38/04* (2013.01); *C22C 38/06* (2013.01); *C22C 38/44* (2013.01); *C22C 38/48* (2013.01); *C22C 38/58* (2013.01); *F01N 13/16* (2013.01); *C21D 6/002* (2013.01)

(58) Field of Classification Search
CPC ..... C22C 38/48; C22C 38/58; C22C 38/60; C21D 6/002; F01N 13/16
USPC ..... 420/42
See application file for complete search history.

(56) References Cited

U.S. PATENT DOCUMENTS

| | | | |
|---|---|---|---|
| 5,470,402 | A | 11/1995 | Nishino et al. |
| 5,582,657 | A | 12/1996 | Watanabe et al. |
| 5,650,024 | A | 7/1997 | Hasegawa et al. |
| 8,721,808 | B2 | 5/2014 | Yamanaka et al. |
| 8,900,510 | B2 | 12/2014 | Kawabata |
| 9,046,029 | B2 | 6/2015 | Kawabata et al. |
| 2007/0215252 | A1* | 9/2007 | Takabayashi ..... C22C 38/24 148/325 |
| 2011/0132499 | A1 | 6/2011 | Yamanaka et al. |
| 2013/0022489 | A1 | 1/2013 | Kawabata |
| 2013/0195713 | A1 | 8/2013 | Kawabata et al. |

FOREIGN PATENT DOCUMENTS

| | | | |
|---|---|---|---|
| CN | 102301029 | A | 12/2011 |
| CN | 102517508 | A | 6/2012 |
| EP | 0635581 | A1 | 1/1995 |
| JP | 63-162818 | A | 7/1988 |
| JP | 01-197046 | A | 8/1989 |
| JP | 07-197209 | A | 8/1995 |
| JP | 08-281380 | A | 10/1996 |
| JP | 9-209090 | A | 8/1997 |
| JP | 1161343 | A | 3/1999 |
| JP | 2003-226990 | A | 8/2003 |
| JP | 2011-157615 | A | 8/2011 |
| WO | 2011125901 | A1 | 10/2011 |
| WO | 2012/043860 | A1 | 4/2012 |

OTHER PUBLICATIONS

International Search Report of PCT/JP2013/077048 dated Nov. 5, 2013.
Communication dated Jun. 9, 2016, from the European Patent Office in counterpart European Application No. 13844899.8.

* cited by examiner

HEAT-RESISTANT, CAST FERRITIC STEEL HAVING EXCELLENT MACHINABILITY AND EXHAUST MEMBER MADE THEREOF

CROSS REFERENCE TO RELATED APPLICATIONS

This is a National Stage of International Application No. PCT/JP2013/077048 filed Oct. 4, 2013 (claiming priority based on Japanese Patent Application No. 2012-224740 filed Oct. 10, 2012), the contents of which are incorporated herein by reference in their entirety.

FIELD OF THE INVENTION

The present invention relates to a heat-resistant, cast steel suitable for exhaust members, etc. for gasoline engines and diesel engines of automobiles, particularly to a heat-resistant, cast ferritic steel having excellent machinability, and an exhaust member made thereof.

BACKGROUND OF THE INVENTION

For the purpose of environmental load reduction and environmental protection recently needed on a global scale, the cleaning of exhaust gases for reducing the emission of air-polluting materials, and the improvement of fuel efficiency (low fuel consumption) for suppressing the emission of $CO_2$, a cause of global warming, are strongly required in automobiles. To clean exhaust gases, and to improve fuel efficiency in automobiles, various technologies such as the development of engines with high performance and fuel efficiency, the cleaning of exhaust gases, the weight reduction of car bodies, the air resistance reduction of car bodies, efficient power transmission from engines to driven systems with low loss, etc. have been developed and employed.

Technologies for providing engines with high performance and improving their fuel efficiency include the direct injection of fuel, increase in fuel injection pressure, increase in compression ratios, decrease in displacements by turbochargers, the reduction of engine weights and sizes (downsizing), etc., are used not only in luxury cars but also in popular cars. As a result, fuel combustion tends to occur at higher temperatures and pressure, resulting in higher-temperature exhaust gases discharged from engines to exhaust members. For example, the temperatures of exhaust gases are near 1000° C. even in popular cars, like luxury sport cars, so that the surface temperatures of exhaust members may reach 900° C. Thus, exhaust members exposed to higher-temperature exhaust gases are required to have higher heat resistance characteristics such as oxidation resistance, high-temperature strength, thermal deformation resistance, thermal cracking resistance, etc. than before.

Exhaust members with complicated shapes, such as exhaust manifolds, turbine housings, etc. used for gasoline engines and diesel engines of automobiles have conventionally been formed by castings with high freedom of shape. In addition, because of their severe, high-temperature use conditions, heat-resistant, cast irons such as high-Si, spheroidal graphite cast irons and Ni-Resist cast iron (Ni—Cr-containing, cast austenitic iron), heat-resistant, cast ferritic steels, heat-resistant, cast austenitic steels, etc. are used.

Though high-Si, spheroidal graphite cast ferritic irons exhibit relatively good heat resistance characteristics at temperatures up to near 800° C., they are poor in durability at higher temperatures than 800° C. Heat-resistant, cast irons such as Ni-Resist cast iron containing large amounts of rare metals such as Ni, Cr, Co, etc., and heat-resistant, cast austenitic steels have satisfactory oxidation resistance at 800° C. or higher and thermal cracking resistance. However, the Ni-Resist cast iron is expensive because of a large Ni content, and has poor thermal cracking resistance because it has a large coefficient of linear expansion due to an austenitic matrix structure, and because its microstructure contains graphite acting as breakage-starting points. The heat-resistant, cast austenitic steels have insufficient thermal cracking resistance at about 900° C. because of a large coefficient of linear expansion, though not containing graphite acting as breakage-starting points. In addition, it is expensive because it contains large amounts of rare metals, and suffers unstable material supply affected by world economic conditions.

From the aspect of economic feasibility, stable material supply and efficient use of resources, heat-resistant cast steels for exhaust members desirably have necessary heat resistance with the amounts of rare metals minimized. Thus provided are inexpensive, high-performance exhaust members, which enable the application of fuel-efficiency-improving technologies to inexpensive popular cars, contributing to reducing the emission of a $CO_2$ gas. To minimize the amounts of rare metals contained, the matrix structures of alloys are advantageously ferritic rather than austenitic. In addition, because heat-resistant, cast ferritic steels have smaller coefficients of linear expansion than those of heat-resistant, cast austenitic steels, the former have better thermal cracking resistance because of smaller thermal stress generated at the start and acceleration of engines.

Because cast exhaust members are subjected to machining such as cutting in surfaces attached to engines or peripheral parts, connecting portions such as mounting holes, portions needing high dimensional precision, etc., and then assembled in automobiles, they should have high machinability. However, heat-resistant, cast steels used for exhaust members are generally difficult-to-cut materials with poor machinability, and particularly heat-resistant, cast ferritic steels have poor machinability, because they contain much Cr for high strength. Accordingly, relatively expensive cutting tools having high hardness and strength are needed to cut exhaust members made of the heat-resistant, cast ferritic steels. Because of a short tool life, tools should be exchanged frequently, resulting in a higher machining cost. Further, because slow cutting is inevitable, cutting needs a long period of time, resulting in low machining efficiency. Thus, exhaust members made of the heat-resistant, cast ferritic steels suffer low machining productivity and poor economic feasibility.

For improved castability, JP 7-197209 A proposes a heat-resistant, cast ferritic steel having excellent castability, which has a composition comprising by weight 0.15-1.20% of C, 0.05-0.45% of C—Nb/8, 2% or less of Si, 2% or less of Mn, 16.0-25.0% of Cr, 1.0-5.0% of W and/or Mo, 0.40-6.0% of Nb, 0.1-2.0% of Ni, and 0.01-0.15% of N, the balance being Fe and inevitable impurities, and has an $\alpha'$ phase ($\alpha$+carbide) transformed from a $\gamma$ phase (austenite phase), in addition to a usual $\alpha$ phase ($\alpha$ ferrite phase), the area ratio of the $\alpha'$ phase [$\alpha'/(\alpha+\alpha')$] being 20-70%. Because this heat-resistant, cast ferritic steel contains C (austenitizing element) in an amount more than necessary for forming NbC, C dissolved in the matrix structure forms a $\gamma$ phase when solidified. The $\gamma$ phase is transformed to an $\alpha'$ phase in a cooling process, thereby improving ductility and oxidation resistance. Accordingly, this heat-resistant, cast ferritic steel is suitable for exhaust members used at 900° C. or higher.

In an as-cast state, however, a γ phase is not sufficiently transformed to an α' phase, but is transformed to a martensite phase. Because the martensite phase has high hardness, it extremely deteriorates room-temperature toughness and machinability. To secure sufficient toughness and machinability, a heat treatment for precipitating the α' phase while disappearing the martensite phase may be necessary. However, a heat treatment generally increasing a production cost nullifies the economic advantages of the heat-resistant, cast ferritic steels with low rare metal contents.

To improve machinability, WO 2012/043860 proposes a heat-resistant, cast ferritic steel having excellent melt flowability, gas defect resistance, toughness and machinability, which has a composition comprising by weight 0.32-0.45% of C, 0.85% or less of Si, 0.15-2% of Mn, 1.5% or less of Ni, 16-23% of Cr, 3.2-4.5% of Nb, Nb/C being 9-11.5, 0.15% or less of N, (Nb/20−0.1) % to 0.2% of S, and 3.2% or less in total of W and/or Mo, the balance being Fe and inevitable impurities, and a structure in which an area ratio of eutectic (δ+NbC) phase formed from δ ferrite and Nb carbide (NbC) is 60-80%, and an area ratio of manganese chromium sulfide (MnCr)S is 0.2-1.2%.

With the amounts of C and Nb increased and their balance optimized, the heat-resistant, cast ferritic steel of WO 2012/043860 has improved melt flowability because of a lowered solidification start temperature, and drastically improved toughness because of finer primary δ crystal grains and eutectic (δ+NbC) crystal grains. Further, with a proper amount of S added, manganese chromium sulfide (MnCr)S is crystallized, resulting in a lower solidification termination temperature and an expanded solidification temperature range, and thus improved gas defect resistance. However, because the heat-resistant, cast ferritic steel of WO 2012/043860 was provided for improved melt flowability, gas defect resistance and toughness, the improvement of machinability has not been sufficiently considered. Namely, though WO 2012/043860 proposes that the amounts of machinability-deteriorating alloy elements contained are restricted by the crystallization of a γ phase transformed to martensite, increase in the amount of carbides precipitated, and increase in the amounts of alloy elements dissolved in a matrix structure, etc., thereby suppressing decrease in the machinability, it does not disclose a means for improving the machinability positively.

Because the heat-resistant, cast ferritic steels of JP 7-197209 A and WO 2012/043860 have enough room for improvement in machinability as described above, a heat-resistant, cast ferritic steel having higher machinability is desired.

OBJECT OF THE INVENTION

Accordingly, an object of the present invention is to provide a heat-resistant, cast ferritic steel having excellent machinability with excellent heat resistance characteristics at around 900° C., and an exhaust member formed by such a heat-resistant, cast ferritic steel.

SUMMARY OF THE INVENTION

As a result of intensive research in view of the above object, the inventors have found that by adding predetermined amounts of Al and S while limiting the amounts of C, Mn, Ni, Cr, Nb and N to proper ranges, the heat-resistant, cast ferritic steels of JP 7-197209 A and WO 2012/043860 can be provided with improved machinability while keeping excellent heat resistance characteristics at around 900° C. The present invention has been completed based on such finding.

Thus, the heat-resistant, cast ferritic steel of the present invention having excellent machinability comprises by mass 0.32-0.48% of C,
0.85% or less of Si,
0.1-2% of Mn,
1.5% or less of Ni,
16-23% of Cr,
3.2-5% of Nb,
Nb/C being 9-11.5,
0.15% or less of N,
0.05-0.2% of S, and
0.01-0.08% of Al, the balance being Fe and inevitable impurities.

The heat-resistant, cast ferritic steel of the present invention may further contain 0.8-3.2% by mass in total of W and/or Mo.

In the heat-resistant, cast ferritic steel of the present invention, Nb and Al preferably meet the following formula (1):

$$0.35 \leq 0.1Nb + Al \leq 0.53 \quad (1),$$

wherein each element symbol represents the amount (% by mass) of each element.

The heat-resistant, cast ferritic steel of the present invention preferably has a structure in which the number of sulfide particles per a field area of 14000 $\mu m^2$ is 20 or more.

The exhaust member of the present invention is formed by the above heat-resistant, cast ferritic steel. Preferred examples of such exhaust members include an exhaust manifold, a turbine housing, a turbine-housing-integrated exhaust manifold, a catalyst case, a catalyst-case-integrated exhaust manifold, and an exhaust outlet.

DESCRIPTION OF THE PREFERRED EMBODIMENTS

[1] Heat-resistant, Cast Ferritic Steel

Figure 1:
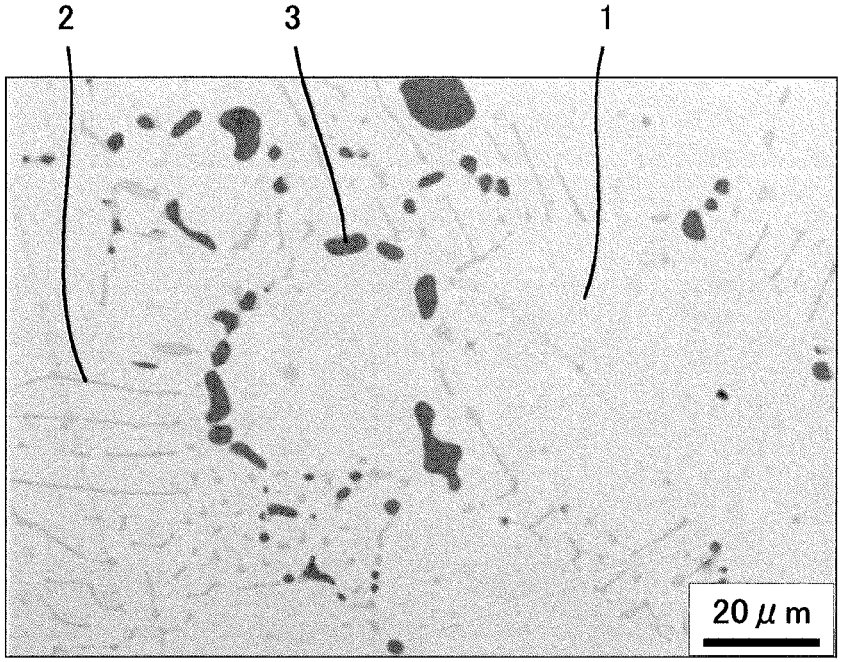
FIG. 1 is a photomicrograph showing the microstructure of the heat-resistant, cast ferritic steel of Example 67.

The composition and structure of the heat-resistant, cast ferritic steel of the present invention will be explained in detail below. The amount of each element is expressed by "% by mass," unless otherwise mentioned.

[A] Composition (1) C (Carbon): 0.32-0.48%

C lowers the solidification start temperature of a melt for the heat-resistant, cast ferritic steel, thereby improving the flowability (melt flowability, castability) of the melt. Also, C contributes to the formation of primary δ crystal phase, which further lowers the solidification start temperature to improve the melt flowability. In addition, C is combined with Nb to form eutectic (δ+NbC) phases of δ phases and Nb carbide (NbC), increasing the high-temperature strength of the heat-resistant, cast ferritic steel. To exhibit such functions effectively, the heat-resistant, cast ferritic steel of the present invention should contain 0.32% or more of C. However, with more than 0.48% of C, eutectic (δ+NbC) phases are excessively formed, providing the heat-resistant, cast ferritic steel with brittleness, low room-temperature toughness, and poor machinability. Accordingly, the C content is 0.32-0.48%. The upper limit of the C content is preferably 0.45%, more preferably 0.44%, most preferably 0.42%.

(2) Si (Silicon): 0.85% or Less

Si functions as a deoxidizer for the melt, and improves the oxidation resistance. However, when Si exceeds 0.85%, Si is dissolved in the ferritic matrix structure, making the matrix structure extremely brittle. Accordingly, the Si content is 0.85% or less (not including 0%). The lower limit of the Si content is preferably 0.2%, more preferably 0.3%. The upper limit of the Si content is preferably 0.6%.

(3) Mn (Manganese): 0.1-2%

Mn functions as a deoxidizer for the melt like Si. In addition, Mn is combined with Cr and S to form sulfides such as manganese sulfide (MnS) and manganese chromium sulfide (MnCr)S, thereby improving the machinability of the heat-resistant, cast steel. Particularly manganese chromium sulfide (MnCr)S expands the solidification temperature range of the heat-resistant, cast ferritic steel, and acts as paths for hydrogen to escape outside, contributing to improving gas defect resistance. To exhibit these effects effectively, the Mn content should be 0.1% or more. However, more than 2% of Mn deteriorates the oxidation resistance and toughness of the heat-resistant, cast ferritic steel. Accordingly, the Mn content is 0.1-2%. The lower limit of the Mn content is preferably 0.15%, more preferably 0.2%. The upper limit of the Mn content is preferably 1.85%, more preferably 1.5%.

(4) Ni (Nickel): 1.5% or Less

Ni is an austenite-stabilizing element, which forms a γ phase. The austenite is transformed to martensite, which extremely deteriorates toughness and machinability, during cooling to room temperature. The Ni content is thus desirably as little as possible. However, because Ni is contained in stainless steel scraps, usual starting materials, it is highly likely contained as an inevitable impurity in the heat-resistant, cast ferritic steel. The upper limit of the Ni content having substantially no adverse effects on toughness and machinability is 1.5%. Accordingly, the Ni content is 1.5% or less (including 0%). The Ni content is preferably 0-1.25%, more preferably 0-1.0%, most preferably 0-0.9%.

(5) Cr (Chromium): 16-23%

Cr stabilizes the ferrite structure and improves the oxidation resistance. It is also combined with Mn and S to form (MnCr)S to improve machinability and gas defect resistance. Particularly to improve oxidation resistance at about 900° C. and machinability, Cr should be 16% or more. On the other hand, with more than 23% of Cr in the ferrite matrix, sigma embrittlement likely occurs, resulting in extremely deteriorated toughness and machinability. Accordingly, the Cr content is 16-23%. The lower limit of the Cr content is preferably 17%, more preferably 17.5%. The upper limit of the Cr content is preferably 22.5%, more preferably 22%.

(6) Nb (Niobium): 3.2-5%

Nb having a strong carbide-forming capability is combined with C to form carbide (NbC) during solidification, thereby preventing C, a strong austenite-stabilizing element, from being dissolved in the ferritic matrix structure to suppress the crystallization of γ phases, and making primary δ crystal grains and eutectic (δ+NbC) crystal grains finer to extremely improve the toughness. By forming eutectic (δ+NbC) phases, Nb improves the high-temperature strength, and lowers the solidification start temperature, keeping good melt flowability. Further, as described below, by forming NbC, it elevates cutting temperature, thereby suppressing built-up edges to improve machinability and thus a tool life. To exhibit the above effects sufficiently, Nb should be 3.2% or more. However, more than 5% of Nb forms too much eutectic (δ+NbC) phases including hard carbide (NbC), rather deteriorating machinability, and extremely lowering toughness by embrittlement. More than 5% of Nb lowers the solidification start temperature to improve melt flowability, but narrows a solidification temperature range to complete solidification in a short period of time, resulting in extremely higher generation of gas defects. Accordingly, the Nb content is 3.2-5%. The lower limit of the Nb content is preferably 3.4%. The upper limit of the Nb content is preferably 4.5%, more preferably 4.2%, most preferably 3.8%.

(7) Nb/C: 9-11.5

The balance of the C content and the Nb content is important to provide the heat-resistant, cast ferritic steel of the present invention with well-balanced properties. Specifically, the limitation of the content ratio (Nb/C) of Nb to C to a particular range makes fine primary δ crystal grains and eutectic (δ+NbC) crystal grains, and crystallizes an excessive part of C as Nb carbide (NbC). As a result, C and Nb are not substantially dissolved in the ferrite matrix, preventing the crystallization of γ phases harmful to toughness, and suppressing Nb from being dissolved in δ phases, thereby preventing the deterioration of toughness and machinability.

When Nb/C is too small, excessive C not combined with Nb is dissolved in the matrix structure, thereby making δ phases unstable, which leads to the crystallization of γ phases. The γ phases are transformed to martensite phases lowering toughness and machinability, until reaching room temperature. Also, when Nb/C is too small, the primary δ crystal phases are crystallized excessively, and their growth is accelerated, failing to obtain fine crystal grains of primary δ phase, and thus failing to improve the toughness. To suppress the crystallization of γ phases, and to make primary δ crystal grains and eutectic (δ+NbC) crystal grains finer, Nb/C should be 9 or more.

On the other hand, when Nb/C is too large, Nb is dissolved in the δ phases to form a solid solution, giving lattice strain to the δ phases, and thus lowering the toughness of the δ phases. Also, when Nb/C is too large, the eutectic (δ+NbC) phases are crystallized excessively, and their growth is accelerated, failing to obtain fully fine crystal grains of eutectic (δ+NbC) phase, and thus failing to improve the toughness. To suppress Nb from being dissolved in the δ phases, and to make primary δ crystal grains and eutectic (δ+NbC) crystal grains finer, Nb/C should be 11.5 or less. Thus, Nb/C is 9-11.5. The lower limit of Nb/C is preferably 9.3, more preferably 9.5. The upper limit of Nb/C is preferably 11.3, more preferably 11, most preferably 10.5.

(8) N (Nitrogen): 0.15% or Less

N is a strong austenite-stabilizing element, forming γ phases. The formed γ phases are transformed to martensite until cooled to room temperature, deteriorating the toughness and machinability. Accordingly, the N content is desirably as small as possible. However, because N is contained in starting materials such as steel scraps, etc., it exists in the cast steel as an inevitable impurity. Because the upper limit of N not substantially deteriorating toughness and machinability is 0.15%, the N content is 0.15% or less (including 0%). The upper limit of the N content is preferably 0.13%, more preferably 0.11%, most preferably 0.10%.

(9) S (Sulfur): 0.05-0.2%

S is an important element for providing the heat-resistant, cast ferritic steel of the present invention with improved machinability. S is combined with Mn and Cr to form spherical or granular sulfides such as MnS, (MnCr)S, etc., improving the machinability. It is known that spherical or granular sulfide particles have a lubricating function and improve machinability by dividing chips, during a cutting operation. It has been found that the addition of both S and Al provides a larger machinability-improving effect than when only sulfide is added. This is an important feature of the present invention. Also, S is combined with Mn and Cr to form manganese chromium sulfide (MnCr)S, thereby expanding a solidification temperature range to improve gas defect resistance. To obtain such effects, S should be 0.05% or more. However, more than 0.2% of S extremely lowers the toughness. Accordingly, the S content is 0.05-0.2%. The lower limit of the S content is preferably 0.08%, more preferably 0.1%, most preferably 0.12%. The upper limit of the S content is preferably 0.18%.

(10) Al (Aluminum): 0.01-0.08%

Al is also an important element for improving the machinability. Usually, Al inevitably coming from starting materials such as steel scraps, etc., and a deoxidizer used in a melting step and a pouring step is introduced into the heat-resistant, cast ferritic steel. To obtain a remarkable machinability-improving effect when used with S, the present invention defines the critical content of Al. For example, when the heat-resistant, cast steel is cut by a tool, Al dissolved in the matrix of the heat-resistant, cast steel is reacted with oxygen in the air by heat generated during cutting, to form $Al_2O_3$, a high-melting-point oxide, on a surface of the heat-resistant, cast steel. $Al_2O_3$ acts as a protective layer, preventing the seizure of the heat-resistant, cast steel to a tool. As a result, the machinability of the heat-resistant, cast steel is improved, resulting in a longer tool life. The effect of improving machinability is not obtained by the addition of Al alone, but obtained by the addition of Al together with a predetermined amount of S. Further, Al makes sulfide particles uniformly finer and suppresses built-up edges, thereby improving the machinability of the heat-resistant, cast steel.

To obtain the effect of remarkably improving machinability by Al, the critical content of Al is 0.01% or more. When Al contained as an inevitable impurity is less than 0.01%, Al should be added intentionally to obtain the above effect. However, when Al exceeds 0.08%, large amounts of inclusions such as oxides such as $Al_2O_3$ , and nitrides such as AlN, etc. are formed in a process of forming the heat-resistant, cast steel by melting. The formation of large amounts of $Al_2O_3$ and AlN, hard and brittle inclusions, rather deteriorates the machinability, and provides the starting points of cracking and breakage, thereby lowering high-temperature strength and ductility. Oxides such as $Al_2O_3$, etc. generate casting defects, and lower the melt flowability to deteriorate casting yield. Accordingly, the Al content is 0.01-0.08%. The lower limit of the Al content is preferably 0.02%, more preferably 0.03%, most preferably 0.035%. The upper limit of the Al content is preferably 0.07%, more preferably 0.06%, most preferably 0.055%.

It has been found that improvement in the machinability of the heat-resistant, cast ferritic steel of the present invention cannot be achieved by the addition of either S or Al, but achieved when both of them are added. Though not necessarily clear, the reason therefor is presumably as follows: Sulfide particles such as MnS, etc. formed in the heat-resistant, cast steel have high ductility and a lubricating function, and $Al_2O_3$ formed by temperature elevation during a cutting operation acts to protect a tool. MnS and $Al_2O_3$ having good affinity to each other form a good composite coating having a lubricating function and a protective function, reducing the sticking of a work to a tool by direct contact, thereby reducing cutting resistance. As a result, the wearing of the tool is suppressed, thereby drastically improving machinability and increasing a tool life. Thus, the heat-resistant, cast ferritic steel of the present invention provided with a satisfactory composite lubricating/protecting coating by limiting the amounts of S, Al and Mn to the above ranges exhibits excellent machinability.

(11) W (Tungsten) and/or Mo (Molybdenum): Preferably 0.8-3.2% in Total

Though both W and Mo form carbides to lower the machinability, they are dissolved in δ phases in the matrix structure, improving the high-temperature strength. To provide the heat-resistant, cast ferritic steel with further improved high-temperature strength in a range not extremely deteriorating machinability, W and/or Mo may be added. Each of W and Mo inevitably coming from starting materials such as steel scraps, etc. is usually contained in the heat-resistant, cast ferritic steel in an amount of less than about 0.5%. However, to obtain the effect of remarkably improving high-temperature strength, W and/or Mo are added preferably in an amount of 0.8% or more in total. When W and Mo added alone or in combination exceed 3.2%, coarse carbides are formed in the heat-resistant, cast ferritic steel, resulting in extremely deteriorated toughness and machinability. The effect of improving high-temperature strength is saturated at about 3%, regardless of whether W and Mo are added alone or in combination. Accordingly, W and/or Mo are 0.8-3.2% in total. The lower limit of the total amount of W and/or Mo is preferably 1.0%. The upper limit of the total amount of W and/or Mo is preferably 3.0%, more preferably 2.5%.

(12) Formula (1): $0.35 \leq 0.1Nb+Al \leq 0.53$

To further improve machinability, the formula (1) is preferably met, in addition to meeting the above composition range requirements. Element symbols in the formula represent their contents (% by mass). The inventors have found that (a) important factors affecting the machinability of the heat-resistant, cast ferritic steel of the present invention are (A) the suppression of built-up edges during a cutting operation, and (B) the control of eutectic carbide and inclusions in the heat-resistant, cast steel; and that (b) these factors depend on the amounts of Nb and Al in the heat-resistant, cast steel, affecting machinability and a tool life. To provide the heat-resistant, cast ferritic steel of the present invention with better machinability, it is preferable to restrict not only the amounts of Nb and/or Al but also their relation as shown in the formula (1). The condition (A) for suppressing built-up edges during a cutting operation is to restrict the value of the formula (1) to 0.35 or more, and the condition (B) for controlling eutectic carbide and inclusions in the heat-resistant, cast steel is to restrict the value of the formula (1) to 0.53 or less.

Part of a work softened by friction heat generated during cutting sticks to a cutting edge of a tool, as a hard accumulate which is called built-up edge. The built-up edges act as secondary cutting edges participating in cutting, thereby largely affecting the tool life. If their volume were small, they would protect the cutting edges of a tool to elongate the tool life, but it is usually not easy to control the amount of built-up edges formed. Particularly because δ-phase ferrite constituting the matrix structure of the heat-resistant, cast ferritic steel easily sticks to a tool, less detachable built-up edges tend to grow larger. When large built-up edges are detached during a cutting operation, the cutting edges of a tool are severely chipped, resulting in poor machinability and a shorter tool life.

(A) Suppression of Built-up Edges

Effective methods for suppressing built-up edges are (A-1) to elevate a cutting temperature by forming a proper amount of eutectic carbide (NbC), and (A-2) to disperse fine sulfide particles uniformly. Though not necessarily clear, the mechanism of suppressing built-up edges by the above means (A-1) and (A-2) are presumably as follows:

(A-1) Formation of Eutectic Carbide (NbC)

A proper amount of hard eutectic carbide (NbC) formed in the heat-resistant, cast steel increases cutting resistance, resulting in a higher friction heat generated by cutting, and thus elevated temperatures (cutting temperatures) of a work, chips and the cutting edges of a tool. With elevated cutting temperature, built-up edges are softened or molten, and easily detached from the cutting edges of a tool, so that their formation and growth are suppressed. As a result, the chipping of cutting edges of a tool by the detachment of large built-up edges is prevented. To obtain the above effect, the area ratio of eutectic carbide (NbC) to the entire structure is preferably 20% or more. To control the area ratio of eutectic carbide (NbC), the amounts of C and Nb and the Nb/C ratio are restricted to the above ranges.

(A-2) Uniformly Dispersed Fine Sulfide Particles

Sulfide particles such as MnS, (MnCr)S, etc. uniformly and finely formed in the heat-resistant, cast steel exhibit a lubricating function and a chip-dividing function during a cutting operation, improving the machinability of the heat-resistant, cast steel. The finer and more uniform dispersion of sulfide particles provides a larger effect of expanding a tool life. Sulfide particles act as sites of forming microcracks, namely the starting points of embrittlement, in a work during cutting, and their lubricating function and chip-dividing function improve the machinability. Particularly, the chip-dividing function of microcracks makes built-up edges smaller and easily detachable, thereby suppressing their formation and growth.

To have large numbers of sites of generating microcracks, sulfide particles are preferably dispersed uniformly and finely. Al is effective to disperse sulfide particles uniformly and finely. Al oxide such as $Al_2O_3$, etc., which is formed by Al contained, is dispersed mainly along δ-phase crystal grain boundaries, and acts as nuclei of crystallizing sulfides, promoting the uniform and fine crystallization of sulfide particles. However, when the amount of Al contained is too small, coarse sulfide particles are dispersed nonuniformly, failing to exhibit the chip-dividing function, and resulting in large built-up edges. The nonuniform dispersion of coarse sulfide particles is presumably caused by the reduction of the amounts of oxides such as $Al_2O_3$, etc. acting as nuclei of crystallizing sulfides, due to an insufficient amount of Al contained, and the reduction of oxygen concentration in a molten steel by the deoxidizing function of Si, Mn, etc. The function of Al oxide of making sulfide particles finer and more uniform differs from the tool-protecting function of high-melting-point $Al_2O_3$ formed from Al dissolved in the matrix by heat generated during cutting.

It is considered that hard carbides lower the machinability to shorten the tool life. In the heat-resistant, cast ferritic steel of the present invention, however, the formation of built-up edges is suppressed by a synergistic effect of (A-1) cutting temperature elevated by the formation of hard eutectic carbide (NbC), and (A-2) Al making sulfide particles finer and more uniform, resulting in improved machinability, and thus an elongated tool life. This is a remarkable effect not expected from a conventional technological common sense. To obtain the above synergistic effect by the means (A-1) and (A-2), the value of the formula (1) is preferably 0.35 or more.

(B) Control of Eutectic Carbide and Inclusions in Heat-resistant, Cast Steel

It is important to control the crystallization of eutectic carbide and inclusions affecting machinability. With a larger amount of eutectic carbide (NbC) crystallized, the effect of suppressing built-up edges is saturated, and larger friction is generated between a tool and a work because the eutectic carbide is hard, so that the tool life is shortened by wearing. To avoid a shortened tool life, the area ratio of eutectic carbide (NbC) to the entire structure is preferably 40% or less. To control the area ratio of eutectic carbide (NbC), the amounts of C and Nb and the Nb/C ratio are restricted to the above ranges.

From the aspect of controlling inclusions, increase in the amount of Al oxide suppressing built-up edges by contributing to the uniform and fine dispersion of sulfide particles saturates the effect of preventing built-up edges. On the other hand, because inclusions such as $Al_2O_3$, AlN, etc. formed from Al contained are hard, increase in their amounts leads to decrease in the machinability. Also, because $Al_2O_3$ tends to be coarsely aggregated in a molten steel, coarser sulfide particles are formed in the presence of a larger amount of nonuniformly dispersed $Al_2O_3$ as nuclei, so that the effect of suppressing built-up edges is lowered. In the heat-resistant, cast ferritic steel of the present invention, decrease in machinability can be suppressed by restricting the crystallization of eutectic carbides and inclusions, thereby improving the tool life. To obtain the above effect, the value of the formula (1) should be 0.53 or less.

[B] Structure (1) Sulfide Particles: 20 or More per a Field Area of 14000 $\mu m^2$ As more sulfide particles are crystallized in the structure, the heat-resistant, cast ferritic steel of the present invention tends to have higher machinability, resulting in a longer tool life. To obtain good machinability, the number of sulfide particles crystallized in the heat-resistant, cast steel structure is preferably 20 or more, more preferably 30 or more, most preferably 40 or more, per a field area of 14000 $\mu m^2$. The number of sulfide particles is determined by counting sulfide particles having particle sizes (equivalent circle diameters) of 1 μm or more by image analysis on a photomicrograph (magnification: 500 times, field: 140 μm×100 μm).

When the number of sulfide particles per a unit area, in other words, the number density of sulfide particles, is larger, finer sulfide particles are dispersed more uniformly. Because more uniform dispersion of finer sulfide particles provides shorter distances between individual sulfide particles, cracks starting from sulfide particles propagate efficiently in chips during cutting, accelerating the division of chips, and thus suppressing the formation and growth of built-up edges. When coarse sulfide particles are dispersed nonuniformly, cracks do not propagate efficiently in chips, so that more built-up edges are formed and grow with chips undivided. With the number of sulfide particles controlled in the above range in the heat-resistant, cast steel, the effect of suppressing built-up edges by a lubricating function and a chip-dividing function is exhibited effectively during a cutting operation, resulting in higher machinability.

As described above, the heat-resistant, cast ferritic steel of the present invention containing both S and Al has drastically improved machinability, by lubrication by sulfide particles, tool protection by high-melting-point Al oxide formed during cutting, cutting temperature elevation by eutectic carbide (NbC) formed by Nb added, and the suppression of built-up edges by uniformly dispersed fine sulfide particles generated due to the presence of Al oxide.

[2] Exhaust Member

The exhaust members of the present invention formed by the above heat-resistant, ferritic cast steel include any cast exhaust members, with their preferred examples including exhaust manifolds, turbine housings, integrally cast turbine housings/exhaust manifolds, catalyst cases, integrally cast catalyst cases/exhaust manifolds, exhaust outlets, etc. Of course, the exhaust members of the present invention are not limited thereto, but include, for example, cast members welded to plate or pipe metal members.

The exhaust members of the present invention keep sufficient heat resistance properties such as oxidation resistance, thermal deformation resistance, thermal cracking resistance, etc., even when their surface temperatures reach about 900° C. by being exposed to an exhaust gas at as high temperatures as 1000° C. or higher. Thus, they exhibit high heat resistance and durability, suitable for exhaust manifolds, turbine housings, exhaust manifolds integral with turbine housings, catalyst cases, exhaust manifolds integral with catalyst cases and exhaust outlets. Also, Because of excellent machinability, they can be economically produced with improved machining productivity, and because of suppressed amounts of rare metals used and no necessity of a heat treatment, they can be produced with high yield at low cost. It is thus expected that the present invention makes it possible to use inexpensive, fuel-efficiency-improving exhaust members with high heat resistance and durability in inexpensive popular cars, contributing to the reduction of $CO_2$ emission.

The present invention will be explained in more detail referring to Examples below without intention of restricting the present invention thereto. Unless otherwise mentioned, "%" expressing the amount of each element constituting the heat-resistant, cast ferritic steel means "% by mass" in Examples and Comparative Examples below.

EXAMPLES 1-88, AND COMPARATIVE EXAMPLES 1-55

The chemical compositions and the values of the formula (1) are shown in Tables 1-1 and 1-2 for the cast steels of Examples 1-42, in Tables 2-1 and 2-2 for the cast steels of Comparative Examples 1-26, in Tables 3-1 and 3-2 for the cast steels of Example 43-88, and in Tables 4-1 and 4-2 for the cast steels of Comparative Examples 27-55. Examples 1-88 are heat-resistant, cast ferritic steels within the composition range of the present invention, and Comparative Examples 1-55 are cast steels outside the composition range of the present invention.

Among the cast steels of Comparative Examples, the cast steels of Comparative Examples 1 and 27 contained too little C;

the cast steels of Comparative Examples 2 and 28 contained too much C;

the cast steels of Comparative Examples 3 and 29 contained too much Si;

the cast steels of Comparative Examples 4 and 30 contained too little Mn;

the cast steels of Comparative Examples 5 and 31 contained too much Mn;

the cast steels of Comparative Examples 6 and 32 contained too little S;

the cast steels of Comparative Examples 7 and 33 contained too much S;

the cast steels of Comparative Examples 8 and 34 contained too much Ni;

the cast steels of Comparative Examples 9 and 35 contained too little Cr;

the cast steels of Comparative Examples 10 and 36 contained too much Cr;

the cast steels of Comparative Examples 11 and 37 contained too much N;

the cast steels of Comparative Examples 12-14 and 38-40 contained too little Nb;

the cast steels of Comparative Examples 15-17 and 41-43 contained too much Nb;

the cast steels of Comparative Examples 18 and 44 had too small Nb/C;

the cast steels of Comparative Examples 19 and 45 had too large Nb/C;

the cast steels of Comparative Examples 20-22 and 46-49 contained too little Al;

the cast steels of Comparative Examples 23-25 and 50-52 contained too much Al;

the cast steels of Comparative Examples 26 and 53 contained too little S and Al;

the cast steel of Comparative Example 54 contained too much W; and the cast steel of Comparative Example 55 contained too much Mo.

Each material of Examples 1-88 and Comparative Examples 1-55 was melted in a 100-kg, high-frequency furnace with a basic lining in the air, taken out of the furnace at 1600-1650° C., and immediately poured at about 1550° C. into a mold for casting a 1-inch Y-block, and a mold for casting a cylindrical block for evaluating machinability, thereby producing samples of each cast steel. A test piece was cut out of each as-cast sample (without heat treatment) to carry out the following evaluations.

(1) Tool Life

An end surface of a cylindrical test piece of 96 mm in outer diameter, 65 mm in inner diameter and 120 mm in height cut out of each sample was machined under the conditions described below by a milling machine using a cemented carbide insert coated with TiAlN by PVD.

Cutting speed: 150 m/minute;

Feed: 0.2 mm/tooth;

Cutting depth: 1.0 mm;

Feeding speed: 48-152 mm/minute;

Rotation speed: 229-763 rpm; and

Cutting liquid: Not used (dry).

Judging that it reached a life when the flank wear of the cemented carbide insert became 0.2 mm in the milling of each cylindrical test piece, cutting time (minute) until reaching the life was regarded as a tool life. The machinability of each cylindrical test piece is expressed by a tool life. Needless to say, a longer tool life means better machinability. Table 1-3 shows the tool lives of Examples 1-42, Table 2-3 shows the tool lives of Comparative Examples 1-26, Table 3-3 shows the tool lives of Examples 43-88, and Table 4-3 shows the tool lives of Comparative Examples 27-55.

Because the tool life is affected by the presence of W and/or Mo, "tool life improvement ratio" was used as an index of machinability improvement, which is not affected by the presence of W and/or Mo. The tool life improvement ratio is a value (A/B) obtained by dividing the tool life A of the cast steel of each Example by the longest tool life B among those of the cast steels of Comparative Examples whose Al content is lower than the lower limit (0.01%) of the present invention. The tool life improvement ratios (expressed by "times") of Examples 1-88 and Comparative Examples 1-55 are shown in Tables 1-3, 2-3, 3-3 and 4-3.

When the tool life improvement ratio is 1.2 times or more, it may be said that the heat-resistant, cast ferritic steel has good machinability. The tool life improvement ratio of the heat-resistant, cast ferritic steel of the present invention is more preferably 1.3 times or more, further preferably 1.35 times or more, still further preferably 1.4 times or more, most preferably 1.5 times or more.

As is clear from Tables 1-3 and 2-3, in cast steels containing small total amounts of W and/or Mo (0.3% or less), any of Examples 1-42 had a tool life improvement ratio of 1.2 times or more the tool life (112 minutes) of the cast steel of Comparative Example 21, which was the longest among those of the cast steels containing less than 0.01% of Al. On the other hand, any of Comparative Examples 2, 4, 6, 8-18 and 20-26 had a tool life improvement ratio of less than 1.2 times. As is clear from Tables 3-3 and 4-3, in cast steels containing large total amounts of W and/or Mo (0.8% or more), any of Examples 43-88 had a tool life improvement ratio of 1.2 times or more the tool life (62 minutes) of the cast steel of Comparative Example 47, which was the longest among those of the cast steels containing less than 0.01% of Al. On the other hand, any of Comparative Examples 28, 30, 32, 34-44, and 46-55 had a tool life improvement ratio of less than 1.2 times. These results indicate that the heat-resistant, cast ferritic steels of the present invention have good machinability.

(2) Structure

The number of sulfide particles such as MnS, (Cr/Mn)S, etc. in a structure-observing test piece cut out of an end portion of each cylindrical test piece after the evaluation of machinability was determined by mirror-polishing each test piece, taking optical photomicrographs of five arbitrary fields without etching, counting the number of sulfide particles having particle sizes (equivalent circle diameters) of 1 μm or more by image analysis in an observation area of 140 μm×100 μm (14000 $\mu m^2$) in each field, and averaging the numbers of sulfide particles in five fields. The results are shown in Table 1-3 for Examples 1-42, in Table 2-3 for Comparative Examples 1-26, in Table 3-3 for Examples 43-88, and in Table 4-3 for Comparative Examples 27-55. Incidentally, sulfide particles were identified by analysis using an energy-dispersive X-ray analyzer attached to a field emission scanning electron microscope (FE-SEM EDS: S-4000, EDX Kevex Delta System available from Hitachi Ltd.).

As is clear from Tables 1-3 and 3-3, the number of sulfide particles per a field area of 14000 $\mu m^2$ was 20 or more in Examples 1-88. On the other hand, as is clear from Tables 2-3 and 4-3, the number of sulfide particles was less than 20 in any of Comparative Examples 20-22, 26, 46-49 and 53 containing too little Al.

Figure 2:
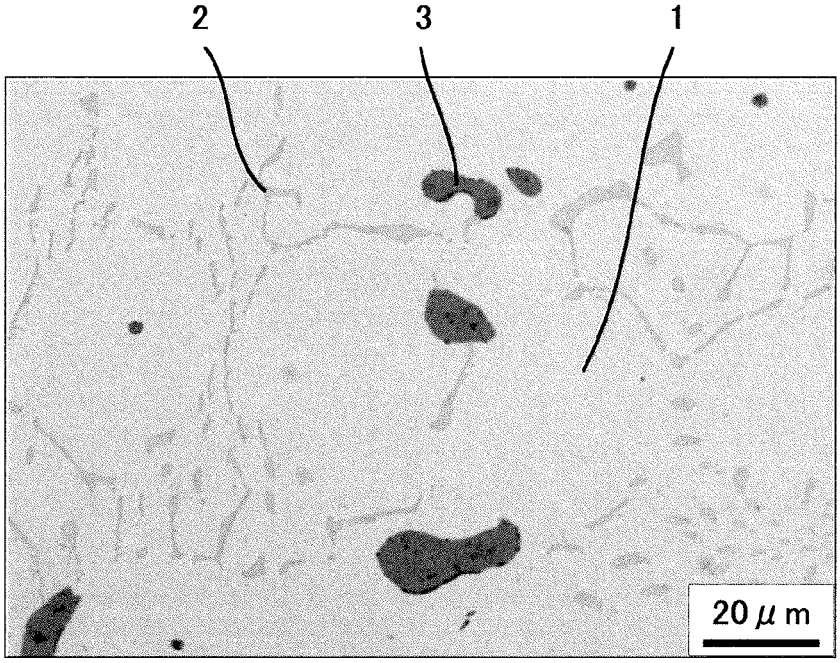
FIG. 2 is a photomicrograph showing the microstructure of the cast steel of Comparative Example 47.

FIG. 1 shows the microstructure of the heat-resistant, cast ferritic steel of Example 67 containing Al within the range of the present invention, and FIG. 2 shows the microstructure of the cast steel of Comparative Example 47 containing too little Al. In FIGS. 1 and 2, white portions 1 are ferrite phases, gray portions 2 are lamellar eutectic carbides of Nb (NbC), and black particles 3 are sulfide particles.

In Example 67, fine sulfide particles were dispersed with few large sulfide particles, as shown in FIG. 1. In Example 67, the number of sulfide particles per a field area of 14000 $\mu m^2$ was 54 when averaged in five fields, resulting in as long a tool life as 102 minutes, and as high a tool life improvement ratio as 1.65 times. This indicates that the heat-resistant, cast ferritic steel of Example 67 has excellent machinability. On the other hand, Comparative Example 47 contained coarsely aggregated sulfide particles without fine sulfide particles dispersed, as shown in FIG. 2. In Comparative Example 47, the number of sulfide particles per a field area of 14000 $\mu m^2$ was 12 when averaged in five fields, resulting in as short a tool life as 62 minutes, and a tool life improvement ratio of 1.0 times.

(3) Weight Loss by Oxidation

Oxide layers are formed on exhaust members exposed to high-temperature exhaust gases of nearly 1000° C. (containing oxidizing gases such as sulfur oxide, nitrogen oxide, etc.) discharged from engines. When oxidation proceeds, cracking occurs from the oxide layers as starting points. As a result, oxidation proceeds inside the exhaust members, so that cracking finally penetrates the exhaust members, causing the leakage of exhaust gases and the breakage of the exhaust members. Because exhaust members exposed to as high exhaust gases as nearly 1000° C. discharged from engines may reach 900° C., the weight loss by oxidation of each cast steel was measured by the following method to evaluate oxidation resistance at 900° C. Namely, a round rod test piece of 10 mm in diameter and 20 mm in length cut out of each 1-inch Y-block sample was kept at 900° C. for 200 hours in the air, shot-blasted to remove oxide scales, and then measured with respect to weight change per a unit area before and after the oxidation test, namely weight loss ($mg/cm^2$) by oxidation. The weight loss by oxidation is shown in Table 1-4 for Examples 1-42, in Table 2-4 for Comparative Examples 1-26, in Table 3-4 for Examples 43-88, and in Table 4-4 for Comparative Examples 27-55.

In order that the heat-resistant, cast ferritic steel has sufficient heat resistance for exhaust members reaching temperatures of around 900° C., the weight loss by oxidation when kept at 900° C. for 200 hours in the air is preferably 20 $mg/cm^2$ or less, more preferably 10 $mg/cm^2$ or less. With the weight loss by oxidation exceeding 20 $mg/cm^2$, oxide layers acting as the starting points of cracking are much formed, resulting in insufficient oxidation resistance.

As is clear from Tables 1-4 and 3-4, the weight loss by oxidation was 20 $mg/cm^2$ or less in all of Examples 1-88, indicating that the heat-resistant, cast ferritic steels of the present invention have excellent oxidation resistance, exhibiting sufficient oxidation resistance when used for exhaust members reaching temperatures of around 900° C. This means that the heat-resistant, cast ferritic steel of the present invention has sufficient oxidation resistance when used for exhaust members reaching temperatures of around 900° C. On the other hand, as is clear from Tables 2-4 and 4-4, any of the cast steels of Comparative Examples 5 and 31 containing excessive Mn and the cast steels of Comparative Examples 9 and 35 containing too little Cr exhibited weight loss by oxidation of more than 20 $mg/cm^2$, poor in oxidation resistance.

(4) High-temperature Yield Strength

Exhaust members are required to have thermal deformation resistance, which makes them resistant to thermal deformation even in the repeated start (heating) and stop (cooling) of engines. To secure sufficient thermal deformation resistance, they preferably have enough high-temperature strength. The high-temperature strength can be evaluated by 0.2% yield strength at 900° C. (high-temperature yield strength). A flanged, smooth, round rod test piece of 50 mm in gauge distance and 10 mm in diameter was cut out of each 1-inch Y-block sample, and attached to an electrohydraulic servo-type material tester (Servopulser EHF-ED10T-20L available from Shimadzu Corporation), to measure the 0.2% yield strength (MPa) of each test piece at 900° C. in the air. The measurement results of the high-temperature yield strength are shown in Table 1-4 for Examples 1-42, in Table 2-4 for Comparative Examples 1-26, in Table 3-4 for Examples 43-88, and in Table 4-4 for Comparative Examples 27-55.

In general, metal materials tend to have lower strength at higher temperatures, more easily subject to thermal deformation. Particularly the heat-resistant, cast ferritic steel having a body-centered cubic (bcc) structure is lower in high-temperature strength and thermal deformation resistance than the heat-resistant, cast austenitic steel having a face-centered cubic (fcc) structure. A main factor affecting high-temperature strength and thermal deformation is high-temperature yield strength. To be used for exhaust members whose temperatures reach about 900° C., the 0.2% yield strength at 900° C. is preferably 20 MPa or more, more preferably 25 MPa or more.

As is clear from Tables 1-4 and 3-4, the 0.2% yield strength at 900° C. (high-temperature yield strength) was 20 MPa or more in all of Examples 1-88. Among them, as shown in Table 3-4, Examples 43-88 containing 0.8% or more of W and/or Mo had high-temperature yield strength of 25 MPa or more, excellent in high-temperature strength and thermal deformation resistance. These results indicate that the heat-resistant, cast ferritic steels of the present invention have excellent high-temperature yield strength, exhibiting sufficient high-temperature strength when used for exhaust members reaching temperatures of about 900° C. On the other hand, Comparative Examples 1, 12-14, 27 and 38-40 containing too little C and/or Nb, Comparative Example 18 having too small a Nb/C ratio, and Comparative Examples 23-25 containing excessive Al had high-temperature yield strength of less than 20 MPa. Incidentally, high-temperature yield strength was high in Comparative Example 44 despite a small Nb/C ratio, and in Comparative Examples 50-52 despite excessive Al, presumably because they contained much W and/or Mo. However, Comparative Examples 44 and 50-52 had low room-temperature impact strength as shown in Table 4-4.

(5) Room-temperature Impact Strength

Because exhaust members are subjected to mechanical vibration and shock in their production process and their assembling process to engines, etc., heat-resistant, cast ferritic steels used therefor should have sufficient room-temperature toughness to avoid cracking and breakage by mechanical vibration and shock. Though tensile elongation (ductility) may be measured to evaluate the toughness, the room-temperature impact strength is measured more practically by a Charpy impact test with a higher propagation speed of cracking than by a tensile test, to evaluate resistance to mechanical vibration and shock (resistance to cracking and breakage).

An un-notched Charpy impact test piece having the shape and size defined in JIS Z 2242 was cut out of each 1-inch Y-block sample. Using a Charpy impact test machine having a capacity of 50 J, the impact test was conducted on three test pieces at 23° C. according to JIS Z 2242, and the measured impact strength was averaged. The impact test results are shown in Table 1-3 for Examples 1-42, Table 2-3 for Comparative Examples 1-26, Table 3-3 for Examples 43-88, and Table 4-3 for Comparative Examples 27-55.

To have enough toughness to avoid cracking and breakage in the production process of exhaust members, etc., the room-temperature impact strength is preferably $10\times10^4$ J/m$^2$ or more, more preferably $15\times10^4$ J/m$^2$ or more. As is clear from Tables 1-3 and 3-3, all of Examples 1-88 had room-temperature impact strength of $10\times10^4$ J/m$^2$ or more. It is presumed that because the heat-resistant, ferritic cast steel of the present invention contains desired amounts of C and Nb, with an optimum ratio of the primary δ crystal phases and eutectic (δ+NbC) phases to make crystal grains fine, it has high room-temperature impact strength (excellent toughness).

On the other hand, any of Comparative Examples 1 and 27 containing too little C, Comparative Examples 2 and 28 containing excessive C, Comparative Examples 3 and 29 containing excessive Si, Comparative Examples 5 and 31 containing excessive Mn, Comparative Examples 7 and 33 containing excessive S, Comparative Examples 8 and 34 containing excessive Ni, Comparative Examples 10 and 36 containing excessive Cr, Comparative Examples 11 and 37 containing excessive N, Comparative Examples 12-14 and 38-40 containing too little Nb, Comparative Examples 15-17 and 41-43 containing excessive Nb, Comparative Example 18 and 44 having too small Nb/C, Comparative Examples 19 and 45 having too large Nb/C, Comparative Examples 23-25 and 50-52 containing excessive Al, and Comparative Examples 54 and 55 containing excessive W or Mo had low room-temperature impact strength, and thus poor toughness.

(6) Thermal Fatigue Life

Exhaust members are required to be resistant to thermal cracking by the repetition of start (heating) and stop (cooling) of engines. The thermal cracking resistance can be evaluated by a thermal fatigue life. The thermal fatigue life was evaluated by a thermal fatigue test, in which a smooth, round rod test piece of 10 mm in diameter and 20 mm in gauge length cut out of each 1-inch Y-block sample was attached to the same electric-hydraulic servo test machine as used in the high-temperature yield strength test at a constraint ratio of 0.5, and subjected to the repetition of heating/cooling cycles in the air to cause thermal fatigue breakage by elongation and shrinkage due to heating and cooling, each cycle consisting of temperature elevation for 2 minutes, keeping the elevated temperature for 1 minute, and cooling for 4 minutes, 7 minutes in total, with the lowest cooling temperature of 150° C., the highest heating temperature of 900° C., and a temperature amplitude of 750° C. More cycles until cracking and deformation generated by the repeated cycles of heating and cooling in the thermal fatigue test cause thermal fatigue breakage indicate a longer thermal fatigue life, meaning better heat resistance (thermal cracking resistance) and durability.

The degree of mechanical constraint (constraint ratio) is expressed by (elongation by free thermal expansion−elongation under mechanical constraint)/(elongation by free thermal expansion). For instance, the constraint ratio of 1.0 is a mechanical constraint condition in which no elongation is permitted to a test piece heated from 150° C. to 900° C. The constraint ratio of 0.5 is a mechanical constraint condition in which, for instance, only 1-mm elongation is permitted when the elongation by free thermal expansion is 2 mm. Accordingly, at a constraint ratio of 0.5, a compression load is applied during temperature elevation, while a tensile load is applied during temperature decrease. The thermal fatigue life was evaluated at a constraint ratio of 0.5, because the constraint ratios of exhaust members for actual automobile engines are about 0.1-0.5, a level permitting elongation to some extent.

A load-temperature diagram was determined from the change of a load caused by the repletion of heating and cooling, and the maximum tensile load at the second cycle was used as a reference (100%), to count as a thermal fatigue life the number of cycles when the maximum tensile load measured in each cycle decreased to 75%. The thermal fatigue lives are shown in Table 1-4 for Examples 1-42, Table 2-4 for Comparative Examples 1-26, in Table 3-4 for Examples 43-88, and in Table 4-4 for Comparative Examples 27-55.

To have sufficient heat resistance at around 900° C., the thermal fatigue life measured by a thermal fatigue test of heating and cooling at a constraint ratio of 0.5 with the highest temperature of 900° C. and the temperature amplitude of 750° C. or higher is preferably 1000 cycles or more. Exhaust members made of a heat-resistant, cast steel having a thermal fatigue life of 1000 cycles or more have excellent thermal cracking resistance, resulting in a long life until thermal fatigue breakage occurs by cracking and deformation due to the repeated heating and cooling of engines. The heat-resistant, cast ferritic steel of the present invention has a thermal fatigue life of more preferably 1400 cycles or more, most preferably 1500 cycles or more, when measured by the above thermal fatigue test.

As is clear from Tables 1-4 and 3-4, the thermal fatigue lives of Examples 1-88 were all 1400 cycles or more. This result indicates that the heat-resistant, cast ferritic steel of the present invention has excellent thermal fatigue life, exhibiting sufficient thermal cracking resistance when used for exhaust members repeatedly subjected to heating to a temperature of around 900° C. and cooling.

As described above, the heat-resistant, cast ferritic steels of the present invention have heat resistance characteristics (oxidation resistance, high-temperature strength, thermal deformation resistance and thermal cracking resistance) required for exhaust members reaching temperatures of around 900° C., as well as excellent machinability.

TABLE 1-1

| No. | C | Si | Mn | Ni | Cr | Nb | Nb/C |
|---|---|---|---|---|---|---|---|
| Example 1 | 0.32 | 0.55 | 0.51 | 0.55 | 16.8 | 3.2 | 10.0 |
| Example 2 | 0.32 | 0.58 | 0.50 | 0.56 | 17.6 | 3.2 | 10.0 |
| Example 3 | 0.33 | 0.60 | 0.49 | 0.48 | 17.5 | 3.2 | 9.7 |
| Example 4 | 0.33 | 0.55 | 0.47 | 0.44 | 17.8 | 3.3 | 10.0 |
| Example 5 | 0.32 | 0.54 | 0.52 | 0.50 | 18.2 | 3.3 | 10.3 |
| Example 6 | 0.33 | 0.57 | 0.45 | 0.52 | 18.3 | 3.2 | 9.7 |
| Example 7 | 0.33 | 0.58 | 0.47 | 0.46 | 18.5 | 3.2 | 9.7 |
| Example 8 | 0.34 | 0.55 | 0.44 | 0.48 | 17.9 | 3.2 | 9.4 |
| Example 9 | 0.34 | 0.52 | 0.46 | 0.47 | 17.8 | 3.2 | 9.4 |
| Example 10 | 0.35 | 0.54 | 0.49 | 0.47 | 17.6 | 3.3 | 9.4 |
| Example 11 | 0.35 | 0.56 | 0.50 | 0.51 | 18.1 | 3.4 | 9.7 |
| Example 12 | 0.36 | 0.59 | 0.48 | 0.53 | 18.3 | 3.4 | 9.4 |
| Example 13 | 0.35 | 0.51 | 0.47 | 0.46 | 18.6 | 3.4 | 9.7 |
| Example 14 | 0.35 | 0.54 | 0.46 | 0.44 | 18.4 | 3.6 | 10.3 |
| Example 15 | 0.35 | 0.57 | 0.46 | 0.43 | 19.2 | 3.6 | 10.3 |
| Example 16 | 0.35 | 0.56 | 0.48 | 0.41 | 19.0 | 3.6 | 10.3 |
| Example 17 | 0.36 | 0.52 | 0.52 | 0.45 | 19.3 | 3.6 | 10.0 |
| Example 18 | 0.36 | 0.54 | 0.46 | 0.47 | 18.8 | 3.6 | 10.0 |
| Example 19 | 0.38 | 0.59 | 0.44 | 0.48 | 18.6 | 3.6 | 9.5 |
| Example 20 | 0.38 | 0.57 | 0.45 | 0.46 | 17.6 | 3.6 | 9.5 |
| Example 21 | 0.37 | 0.55 | 0.47 | 0.40 | 17.9 | 3.8 | 10.3 |
| Example 22 | 0.37 | 0.52 | 0.47 | 0.37 | 17.4 | 3.8 | 10.3 |
| Example 23 | 0.38 | 0.54 | 0.46 | 0.42 | 17.7 | 3.8 | 10.0 |
| Example 24 | 0.37 | 0.53 | 0.46 | 0.40 | 17.4 | 3.8 | 10.3 |
| Example 25 | 0.38 | 0.60 | 0.48 | 0.45 | 17.6 | 3.8 | 10.0 |
| Example 26 | 0.38 | 0.59 | 0.48 | 0.46 | 17.8 | 4.0 | 10.5 |
| Example 27 | 0.38 | 0.53 | 0.46 | 0.31 | 17.4 | 4.0 | 10.6 |
| Example 28 | 0.42 | 0.57 | 0.51 | 0.38 | 17.6 | 4.0 | 9.5 |
| Example 29 | 0.42 | 0.56 | 0.52 | 0.39 | 18.0 | 4.2 | 10.0 |
| Example 30 | 0.42 | 0.52 | 0.50 | 0.42 | 18.5 | 4.5 | 10.7 |
| Example 31 | 0.42 | 0.54 | 0.46 | 0.41 | 18.8 | 4.5 | 10.7 |
| Example 32 | 0.44 | 0.58 | 0.46 | 0.43 | 18.5 | 4.7 | 10.7 |
| Example 33 | 0.44 | 0.60 | 0.48 | 0.44 | 18.2 | 5.0 | 11.4 |
| Example 34 | 0.48 | 0.57 | 0.53 | 0.49 | 18.7 | 5.0 | 10.4 |
| Example 35 | 0.45 | 0.59 | 0.49 | 0.53 | 19.0 | 4.8 | 10.7 |
| Example 36 | 0.48 | 0.53 | 0.52 | 0.50 | 19.3 | 5.0 | 10.4 |
| Example 37 | 0.48 | 0.57 | 0.56 | 0.54 | 18.8 | 5.0 | 10.4 |

TABLE 1-1-continued

| No. | C | Si | Mn | Ni | Cr | Nb | Nb/C |
|---|---|---|---|---|---|---|---|
| Example 38 | 0.40 | 0.35 | 1.21 | 0.61 | 16.1 | 3.9 | 9.8 |
| Example 39 | 0.42 | 0.85 | 1.85 | 1.35 | 22.0 | 3.8 | 9.0 |
| Example 40 | 0.38 | 0.51 | 0.50 | 1.45 | 22.5 | 4.2 | 11.1 |
| Example 41 | 0.38 | 0.59 | 0.14 | 0.38 | 18.0 | 4.0 | 10.5 |
| Example 42 | 0.35 | 0.62 | 0.55 | 0.45 | 18.2 | 3.2 | 9.1 |

TABLE 1-2

| No. | S | Al | 0.1Nb + Al | N | W | Mo | W + Mo |
|---|---|---|---|---|---|---|---|
| Example 1 | 0.136 | 0.010 | 0.33 | 0.08 | 0.1 | 0.0 | 0.1 |
| Example 2 | 0.145 | 0.021 | 0.34 | 0.09 | 0.1 | 0.0 | 0.1 |
| Example 3 | 0.148 | 0.024 | 0.34 | 0.07 | 0.1 | 0.0 | 0.1 |
| Example 4 | 0.146 | 0.011 | 0.34 | 0.08 | 0.0 | 0.1 | 0.1 |
| Example 5 | 0.150 | 0.014 | 0.34 | 0.06 | 0.0 | 0.0 | 0.1 |
| Example 6 | 0.153 | 0.030 | 0.35 | 0.08 | 0.0 | 0.0 | 0.1 |
| Example 7 | 0.145 | 0.044 | 0.36 | 0.07 | 0.1 | 0.0 | 0.1 |
| Example 8 | 0.144 | 0.062 | 0.38 | 0.09 | 0.1 | 0.0 | 0.1 |
| Example 9 | 0.138 | 0.078 | 0.40 | 0.09 | 0.0 | 0.0 | 0.1 |
| Example 10 | 0.142 | 0.021 | 0.35 | 0.08 | 0.1 | 0.0 | 0.1 |
| Example 11 | 0.140 | 0.030 | 0.37 | 0.06 | 0.0 | 0.0 | 0.1 |
| Example 12 | 0.141 | 0.042 | 0.38 | 0.05 | 0.1 | 0.0 | 0.1 |
| Example 13 | 0.150 | 0.067 | 0.41 | 0.07 | 0.1 | 0.0 | 0.1 |
| Example 14 | 0.146 | 0.015 | 0.38 | 0.07 | 0.0 | 0.0 | 0.1 |
| Example 15 | 0.148 | 0.027 | 0.39 | 0.08 | 0.1 | 0.0 | 0.1 |
| Example 16 | 0.143 | 0.032 | 0.39 | 0.09 | 0.1 | 0.0 | 0.1 |
| Example 17 | 0.145 | 0.042 | 0.40 | 0.08 | 0.0 | 0.0 | 0.1 |
| Example 18 | 0.152 | 0.057 | 0.42 | 0.07 | 0.0 | 0.0 | 0.0 |
| Example 19 | 0.155 | 0.064 | 0.42 | 0.07 | 0.1 | 0.1 | 0.2 |
| Example 20 | 0.163 | 0.078 | 0.44 | 0.08 | 0.1 | 0.0 | 0.2 |
| Example 21 | 0.144 | 0.028 | 0.41 | 0.09 | 0.1 | 0.0 | 0.1 |
| Example 22 | 0.141 | 0.034 | 0.42 | 0.08 | 0.1 | 0.1 | 0.2 |
| Example 23 | 0.143 | 0.054 | 0.43 | 0.08 | 0.1 | 0.1 | 0.2 |
| Example 24 | 0.144 | 0.057 | 0.44 | 0.08 | 0.1 | 0.1 | 0.2 |
| Example 25 | 0.148 | 0.077 | 0.46 | 0.09 | 0.2 | 0.1 | 0.3 |
| Example 26 | 0.149 | 0.025 | 0.43 | 0.10 | 0.1 | 0.1 | 0.3 |
| Example 27 | 0.143 | 0.041 | 0.44 | 0.08 | 0.1 | 0.1 | 0.2 |
| Example 28 | 0.142 | 0.063 | 0.46 | 0.06 | 0.1 | 0.0 | 0.1 |
| Example 29 | 0.149 | 0.053 | 0.47 | 0.07 | 0.1 | 0.0 | 0.1 |
| Example 30 | 0.156 | 0.051 | 0.50 | 0.06 | 0.1 | 0.1 | 0.2 |
| Example 31 | 0.153 | 0.080 | 0.53 | 0.08 | 0.1 | 0.0 | 0.2 |
| Example 32 | 0.150 | 0.055 | 0.53 | 0.09 | 0.1 | 0.0 | 0.1 |
| Example 33 | 0.156 | 0.010 | 0.51 | 0.10 | 0.1 | 0.0 | 0.1 |
| Example 34 | 0.159 | 0.030 | 0.53 | 0.11 | 0.1 | 0.0 | 0.1 |
| Example 35 | 0.152 | 0.056 | 0.54 | 0.12 | 0.1 | 0.0 | 0.1 |
| Example 36 | 0.154 | 0.036 | 0.54 | 0.13 | 0.1 | 0.1 | 0.2 |
| Example 37 | 0.153 | 0.079 | 0.58 | 0.09 | 0.1 | 0.1 | 0.2 |
| Example 38 | 0.147 | 0.045 | 0.44 | 0.10 | 0.1 | 0.0 | 0.1 |
| Example 39 | 0.168 | 0.041 | 0.42 | 0.14 | 0.1 | 0.0 | 0.1 |
| Example 40 | 0.175 | 0.038 | 0.46 | 0.09 | 0.1 | 0.0 | 0.1 |
| Example 41 | 0.055 | 0.040 | 0.44 | 0.09 | 0.1 | 0.0 | 0.1 |
| Example 42 | 0.195 | 0.052 | 0.37 | 0.08 | 0.0 | 0.1 | 0.1 |

TABLE 1-3

| No. | Number of Sulfide Particles (/14000 $\mu m^2$) | Tool Life (minute) | Tool Life Improvement Ratio (times) | Room-Temperature Impact Strength ($\times 10^4$ J/$m^2$) |
|---|---|---|---|---|
| Example 1 | 22 | 135 | 1.21 | 26.5 |
| Example 2 | 33 | 138 | 1.23 | 24.8 |
| Example 3 | 34 | 139 | 1.24 | 25.7 |
| Example 4 | 24 | 135 | 1.21 | 26.2 |
| Example 5 | 23 | 137 | 1.22 | 25.9 |
| Example 6 | 36 | 152 | 1.36 | 24.7 |
| Example 7 | 44 | 155 | 1.38 | 24.1 |
| Example 8 | 32 | 149 | 1.33 | 20.5 |
| Example 9 | 30 | 144 | 1.29 | 19.2 |
| Example 10 | 32 | 151 | 1.35 | 20.8 |
| Example 11 | 37 | 158 | 1.41 | 23.6 |
| Example 12 | 42 | 169 | 1.51 | 20.5 |
| Example 13 | 32 | 149 | 1.33 | 21.6 |

TABLE 1-3-continued

| No. | Number of Sulfide Particles (/14000 μm²) | Tool Life (minute) | Tool Life Improvement Ratio (times) | Room-Temperature Impact Strength (×10⁴ J/m²) |
|---|---|---|---|---|
| Example 14 | 28 | 143 | 1.28 | 25.3 |
| Example 15 | 33 | 149 | 1.33 | 24.5 |
| Example 16 | 39 | 160 | 1.43 | 26.0 |
| Example 17 | 52 | 172 | 1.54 | 25.3 |
| Example 18 | 38 | 165 | 1.47 | 22.8 |
| Example 19 | 34 | 150 | 1.34 | 22.0 |
| Example 20 | 32 | 143 | 1.28 | 22.3 |
| Example 21 | 33 | 150 | 1.34 | 24.1 |
| Example 22 | 37 | 160 | 1.43 | 23.8 |
| Example 23 | 51 | 168 | 1.50 | 22.6 |
| Example 24 | 36 | 162 | 1.45 | 22.3 |
| Example 25 | 31 | 142 | 1.27 | 22.1 |
| Example 26 | 32 | 148 | 1.32 | 23.5 |
| Example 27 | 46 | 158 | 1.41 | 23.1 |
| Example 28 | 34 | 150 | 1.34 | 22.0 |
| Example 29 | 44 | 158 | 1.41 | 22.1 |
| Example 30 | 48 | 151 | 1.35 | 20.7 |
| Example 31 | 33 | 143 | 1.28 | 13.5 |
| Example 32 | 41 | 146 | 1.30 | 16.4 |
| Example 33 | 22 | 142 | 1.27 | 11.3 |
| Example 34 | 35 | 147 | 1.31 | 10.8 |
| Example 35 | 38 | 139 | 1.24 | 14.6 |
| Example 36 | 42 | 137 | 1.22 | 15.1 |
| Example 37 | 32 | 134 | 1.20 | 10.6 |
| Example 38 | 56 | 171 | 1.53 | 20.2 |
| Example 39 | 48 | 170 | 1.52 | 13.5 |
| Example 40 | 42 | 157 | 1.40 | 10.6 |
| Example 41 | 53 | 158 | 1.41 | 22.4 |
| Example 42 | 48 | 151 | 1.35 | 15.2 |

TABLE 1-4

| No. | Weight Loss by Oxidation at 900° C. (mg/cm²) | 0.2% Yield Strength at 900° C. (MPa) | Thermal Fatigue Life(1) (cycle) |
|---|---|---|---|
| Example 1 | 3 | 20 | 1408 |
| Example 2 | 1 | 21 | 1489 |
| Example 3 | 1 | 22 | 1503 |
| Example 4 | 1 | 23 | 1512 |
| Example 5 | 1 | 22 | 1507 |
| Example 6 | 1 | 21 | 1496 |
| Example 7 | 1 | 22 | 1503 |
| Example 8 | 1 | 23 | 1493 |
| Example 9 | 1 | 20 | 1437 |
| Example 10 | 1 | 23 | 1485 |
| Example 11 | 1 | 22 | 1506 |
| Example 12 | 1 | 22 | 1489 |
| Example 13 | 1 | 22 | 1500 |
| Example 14 | 1 | 22 | 1495 |
| Example 15 | 1 | 23 | 1526 |
| Example 16 | 1 | 21 | 1517 |
| Example 17 | 1 | 22 | 1518 |
| Example 18 | 1 | 23 | 1505 |
| Example 19 | 1 | 23 | 1494 |
| Example 20 | 1 | 21 | 1477 |
| Example 21 | 1 | 22 | 1492 |
| Example 22 | 2 | 22 | 1422 |
| Example 23 | 1 | 23 | 1486 |
| Example 24 | 2 | 21 | 1417 |
| Example 25 | 1 | 20 | 1442 |
| Example 26 | 1 | 23 | 1511 |
| Example 27 | 2 | 24 | 1506 |
| Example 28 | 1 | 22 | 1473 |
| Example 29 | 1 | 23 | 1490 |
| Example 30 | 1 | 22 | 1488 |
| Example 31 | 1 | 20 | 1432 |
| Example 32 | 1 | 22 | 1497 |
| Example 33 | 1 | 24 | 1478 |
| Example 34 | 1 | 23 | 1466 |
| Example 35 | 1 | 22 | 1481 |
| Example 36 | 1 | 24 | 1486 |

TABLE 1-4-continued

| No. | Weight Loss by Oxidation at 900° C. (mg/cm²) | 0.2% Yield Strength at 900° C. (MPa) | Thermal Fatigue Life(1) (cycle) |
|---|---|---|---|
| Example 37 | 1 | 21 | 1433 |
| Example 38 | 13 | 24 | 1401 |
| Example 39 | 3 | 24 | 1510 |
| Example 40 | 1 | 23 | 1502 |
| Example 41 | 1 | 22 | 1496 |
| Example 42 | 1 | 20 | 1425 |

Note:
(1)At a constraint ratio of 0.5.

TABLE 2-1

| No. | C | Si | Mn | Ni | Cr | Nb | Nb/C |
|---|---|---|---|---|---|---|---|
| Com. Ex. 1 | 0.30 | 0.55 | 0.52 | 0.46 | 18.2 | 3.4 | 11.3 |
| Com. Ex. 2 | 0.50 | 0.53 | 0.56 | 0.52 | 17.8 | 4.7 | 9.4 |
| Com. Ex. 3 | 0.38 | 0.90 | 0.46 | 0.44 | 18.1 | 3.8 | 10.0 |
| Com. Ex. 4 | 0.35 | 0.55 | 0.08 | 0.69 | 18.0 | 3.5 | 10.0 |
| Com. Ex. 5 | 0.36 | 0.56 | 2.15 | 0.67 | 17.9 | 3.5 | 9.7 |
| Com. Ex. 6 | 0.38 | 0.54 | 0.47 | 0.30 | 17.3 | 3.8 | 10.0 |
| Com. Ex. 7 | 0.38 | 0.50 | 0.51 | 0.48 | 17.6 | 3.7 | 9.7 |
| Com. Ex. 8 | 0.37 | 0.48 | 0.48 | 1.62 | 17.5 | 3.8 | 10.3 |
| Com. Ex. 9 | 0.38 | 0.57 | 0.52 | 0.69 | 15.5 | 3.8 | 10.0 |
| Com. Ex. 10 | 0.38 | 0.53 | 0.50 | 0.66 | 25.1 | 3.8 | 10.0 |
| Com. Ex. 11 | 0.37 | 0.49 | 0.51 | 0.57 | 17.7 | 3.5 | 9.5 |
| Com. Ex. 12 | 0.32 | 0.65 | 0.44 | 0.51 | 17.6 | 3.0 | 9.4 |
| Com. Ex. 13 | 0.32 | 0.68 | 0.45 | 0.52 | 17.8 | 3.0 | 9.4 |
| Com. Ex. 14 | 0.33 | 0.67 | 0.47 | 0.56 | 18.2 | 3.0 | 9.1 |
| Com. Ex. 15 | 0.48 | 0.60 | 0.54 | 0.63 | 17.2 | 5.4 | 11.3 |
| Com. Ex. 16 | 0.48 | 0.53 | 0.60 | 0.54 | 17.6 | 5.3 | 11.0 |
| Com. Ex. 17 | 0.46 | 0.57 | 0.53 | 0.57 | 17.3 | 5.1 | 11.1 |
| Com. Ex. 18 | 0.45 | 0.55 | 0.62 | 0.49 | 17.9 | 3.8 | 8.4 |
| Com. Ex. 19 | 0.33 | 0.54 | 0.53 | 0.46 | 17.8 | 4.2 | 12.7 |
| Com. Ex. 20 | 0.34 | 0.61 | 0.61 | 0.63 | 17.5 | 3.3 | 9.7 |
| Com. Ex. 21 | 0.38 | 0.53 | 0.46 | 0.36 | 17.2 | 3.8 | 9.9 |
| Com. Ex. 22 | 0.42 | 0.65 | 0.55 | 0.58 | 18.1 | 4.2 | 10.0 |
| Com. Ex. 23 | 0.34 | 0.50 | 0.50 | 0.42 | 17.6 | 3.4 | 10.0 |
| Com. Ex. 24 | 0.38 | 0.45 | 0.52 | 0.45 | 17.8 | 3.8 | 10.0 |
| Com. Ex. 25 | 0.42 | 0.42 | 0.51 | 0.44 | 16.9 | 4.2 | 10.0 |
| Com. Ex. 26 | 0.37 | 0.52 | 0.48 | 0.32 | 17.1 | 3.9 | 10.5 |

TABLE 2-2

| No. | S | Al | 0.1Nb + Al | N | W | Mo | W + Mo |
|---|---|---|---|---|---|---|---|
| Com. Ex. 1 | 0.145 | 0.015 | 0.36 | 0.08 | 0.0 | 0.0 | 0.0 |
| Com. Ex. 2 | 0.144 | 0.036 | 0.51 | 0.07 | 0.1 | 0.0 | 0.1 |
| Com. Ex. 3 | 0.150 | 0.024 | 0.40 | 0.08 | 0.0 | 0.0 | 0.0 |
| Com. Ex. 4 | 0.157 | 0.026 | 0.38 | 0.07 | 0.0 | 0.0 | 0.0 |
| Com. Ex. 5 | 0.156 | 0.025 | 0.38 | 0.08 | 0.0 | 0.0 | 0.1 |
| Com. Ex. 6 | 0.036 | 0.032 | 0.41 | 0.07 | 0.1 | 0.0 | 0.1 |
| Com. Ex. 7 | 0.225 | 0.012 | 0.38 | 0.07 | 0.0 | 0.0 | 0.1 |
| Com. Ex. 8 | 0.148 | 0.038 | 0.42 | 0.09 | 0.0 | 0.0 | 0.0 |
| Com. Ex. 9 | 0.146 | 0.067 | 0.45 | 0.09 | 0.1 | 0.1 | 0.2 |
| Com. Ex. 10 | 0.150 | 0.042 | 0.42 | 0.07 | 0.0 | 0.0 | 0.0 |
| Com. Ex. 11 | 0.152 | 0.028 | 0.38 | 0.18 | 0.0 | 0.0 | 0.0 |
| Com. Ex. 12 | 0.148 | 0.018 | 0.32 | 0.08 | 0.0 | 0.0 | 0.0 |
| Com. Ex. 13 | 0.151 | 0.040 | 0.34 | 0.09 | 0.0 | 0.0 | 0.0 |
| Com. Ex. 14 | 0.146 | 0.076 | 0.38 | 0.08 | 0.0 | 0.0 | 0.0 |
| Com. Ex. 15 | 0.142 | 0.012 | 0.55 | 0.09 | 0.0 | 0.0 | 0.0 |
| Com. Ex. 16 | 0.147 | 0.037 | 0.57 | 0.07 | 0.0 | 0.0 | 0.0 |
| Com. Ex. 17 | 0.148 | 0.077 | 0.59 | 0.08 | 0.0 | 0.0 | 0.0 |
| Com. Ex. 18 | 0.165 | 0.032 | 0.41 | 0.08 | 0.0 | 0.0 | 0.0 |
| Com. Ex. 19 | 0.155 | 0.016 | 0.44 | 0.08 | 0.0 | 0.0 | 0.1 |
| Com. Ex. 20 | 0.154 | 0.008 | 0.34 | 0.07 | 0.1 | 0.0 | 0.1 |
| Com. Ex. 21 | 0.150 | 0.002 | 0.38 | 0.08 | 0.1 | 0.1 | 0.2 |
| Com. Ex. 22 | 0.167 | 0.009 | 0.43 | 0.08 | 0.1 | 0.0 | 0.1 |
| Com. Ex. 23 | 0.153 | 0.082 | 0.42 | 0.06 | 0.1 | 0.0 | 0.1 |
| Com. Ex. 24 | 0.155 | 0.085 | 0.47 | 0.08 | 0.1 | 0.0 | 0.1 |
| Com. Ex. 25 | 0.157 | 0.083 | 0.50 | 0.07 | 0.1 | 0.0 | 0.1 |
| Com. Ex. 26 | 0.012 | 0.003 | 0.39 | 0.06 | 0.0 | 0.0 | 0.0 |

TABLE 2-3

| No. | Number of Sulfide Particles (/14000 μm²) | Tool Life (minute) | Tool Life Improvement Ratio (times) | Room-Temperature Impact Strength (×10⁴ J/m²) |
|---|---|---|---|---|
| Com. Ex. 1 | 23 | 140 | 1.25 | 9.8 |
| Com. Ex. 2 | 43 | 97 | 0.87 | 9.8 |
| Com. Ex. 3 | 31 | 148 | 1.32 | 5.2 |
| Com. Ex. 4 | 5 | 82 | 0.73 | 12.8 |
| Com. Ex. 5 | 34 | 146 | 1.30 | 8.4 |
| Com. Ex. 6 | 11 | 103 | 0.92 | 18.3 |
| Com. Ex. 7 | 25 | 144 | 1.29 | 7.5 |
| Com. Ex. 8 | 42 | 109 | 0.97 | 6.0 |
| Com. Ex. 9 | 34 | 110 | 0.98 | 13.8 |
| Com. Ex. 10 | 50 | 110 | 0.98 | 6.7 |
| Com. Ex. 11 | 34 | 108 | 0.96 | 4.2 |
| Com. Ex. 12 | 21 | 97 | 0.87 | 4.8 |
| Com. Ex. 13 | 42 | 105 | 0.94 | 4.6 |
| Com. Ex. 14 | 31 | 102 | 0.91 | 4.1 |
| Com. Ex. 15 | 23 | 99 | 0.88 | 8.2 |
| Com. Ex. 16 | 41 | 100 | 0.89 | 7.6 |
| Com. Ex. 17 | 30 | 85 | 0.76 | 5.5 |
| Com. Ex. 18 | 35 | 106 | 0.95 | 8.4 |
| Com. Ex. 19 | 27 | 140 | 1.25 | 7.3 |
| Com. Ex. 20 | 18 | 110 | 0.98 | 23.0 |
| Com. Ex. 21 | 17 | 112 | 1.00 | 24.0 |
| Com. Ex. 22 | 18 | 111 | 0.99 | 22.5 |
| Com. Ex. 23 | 21 | 110 | 0.98 | 9.3 |
| Com. Ex. 24 | 20 | 104 | 0.93 | 9.1 |
| Com. Ex. 25 | 22 | 99 | 0.88 | 8.7 |
| Com. Ex. 26 | 8 | 94 | 0.84 | 24.3 |

TABLE 2-4

| No. | Weight Loss by Oxidation at 900° C. (mg/cm²) | 0.2% Yield Strength at 900° C. (MPa) | Thermal Fatigue Life(1) (cycle) |
|---|---|---|---|
| Com. Ex. 1 | 2 | 18 | 1393 |
| Com. Ex. 2 | 1 | 24 | 1467 |
| Com. Ex. 3 | 1 | 23 | 1411 |
| Com. Ex. 4 | 1 | 22 | 1454 |
| Com. Ex. 5 | 28 | 23 | 1382 |
| Com. Ex. 6 | 2 | 21 | 1421 |
| Com. Ex. 7 | 3 | 21 | 1406 |
| Com. Ex. 8 | 1 | 22 | 1412 |
| Com. Ex. 9 | 101 | 23 | 1365 |
| Com. Ex. 10 | 1 | 21 | 1533 |
| Com. Ex. 11 | 2 | 23 | 1428 |
| Com. Ex. 12 | 3 | 18 | 1377 |
| Com. Ex. 13 | 3 | 18 | 1384 |
| Com. Ex. 14 | 2 | 19 | 1395 |
| Com. Ex. 15 | 3 | 24 | 1423 |
| Com. Ex. 16 | 2 | 22 | 1410 |
| Com. Ex. 17 | 3 | 21 | 1405 |
| Com. Ex. 18 | 2 | 18 | 1386 |
| Com. Ex. 19 | 1 | 22 | 1414 |
| Com. Ex. 20 | 2 | 20 | 1403 |
| Com. Ex. 21 | 3 | 20 | 1405 |
| Com. Ex. 22 | 1 | 22 | 1485 |
| Com. Ex. 23 | 1 | 19 | 1388 |
| Com. Ex. 24 | 1 | 17 | 1385 |
| Com. Ex. 25 | 1 | 16 | 1376 |
| Com. Ex. 26 | 4 | 22 | 1408 |

Note:
(1)At a constraint ratio of 0.5.

TABLE 3-1

| No. | C | Si | Mn | Ni | Cr | Nb | Nb/C |
|---|---|---|---|---|---|---|---|
| Example 43 | 0.32 | 0.53 | 0.48 | 0.61 | 17.2 | 3.2 | 10.0 |
| Example 44 | 0.32 | 0.56 | 0.46 | 0.58 | 17.8 | 3.2 | 10.0 |
| Example 45 | 0.32 | 0.58 | 0.50 | 0.49 | 16.9 | 3.2 | 10.0 |
| Example 46 | 0.33 | 0.54 | 0.48 | 0.57 | 17.4 | 3.3 | 10.0 |

TABLE 3-1-continued

| No. | C | Si | Mn | Ni | Cr | Nb | Nb/C |
|---|---|---|---|---|---|---|---|
| Example 47 | 0.32 | 0.54 | 0.51 | 0.52 | 18.0 | 3.3 | 10.3 |
| Example 48 | 0.32 | 0.56 | 0.44 | 0.53 | 18.3 | 3.2 | 10.0 |
| Example 49 | 0.33 | 0.57 | 0.48 | 0.49 | 17.9 | 3.2 | 9.7 |
| Example 50 | 0.33 | 0.60 | 0.42 | 0.51 | 17.5 | 3.2 | 9.7 |
| Example 51 | 0.34 | 0.53 | 0.55 | 0.55 | 17.6 | 3.2 | 9.4 |
| Example 52 | 0.34 | 0.51 | 0.52 | 0.48 | 17.4 | 3.3 | 9.7 |
| Example 53 | 0.35 | 0.62 | 0.51 | 0.50 | 18.0 | 3.4 | 9.7 |
| Example 54 | 0.35 | 0.63 | 0.49 | 0.53 | 18.5 | 3.4 | 9.7 |
| Example 55 | 0.35 | 0.54 | 0.47 | 0.45 | 18.7 | 3.4 | 9.7 |
| Example 56 | 0.36 | 0.55 | 0.45 | 0.51 | 17.9 | 3.6 | 10.0 |
| Example 57 | 0.34 | 0.59 | 0.47 | 0.42 | 17.0 | 3.6 | 10.6 |
| Example 58 | 0.35 | 0.58 | 0.47 | 0.42 | 18.5 | 3.6 | 10.3 |
| Example 59 | 0.36 | 0.52 | 0.51 | 0.44 | 18.6 | 3.6 | 10.0 |
| Example 60 | 0.37 | 0.53 | 0.56 | 0.53 | 17.9 | 3.6 | 9.7 |
| Example 61 | 0.38 | 0.62 | 0.55 | 0.39 | 18.0 | 3.6 | 9.5 |
| Example 62 | 0.38 | 0.51 | 0.48 | 0.47 | 17.5 | 3.6 | 9.5 |
| Example 63 | 0.35 | 0.53 | 0.47 | 0.33 | 19.4 | 3.7 | 10.6 |
| Example 64 | 0.37 | 0.52 | 0.45 | 0.35 | 19.4 | 3.7 | 9.9 |
| Example 65 | 0.38 | 0.54 | 0.49 | 0.38 | 19.1 | 3.8 | 10.0 |
| Example 66 | 0.38 | 0.53 | 0.46 | 0.36 | 18.8 | 3.8 | 10.1 |
| Example 67 | 0.38 | 0.54 | 0.47 | 0.40 | 18.7 | 3.8 | 10.0 |
| Example 68 | 0.38 | 0.52 | 0.46 | 0.41 | 17.3 | 3.8 | 10.0 |
| Example 69 | 0.38 | 0.59 | 0.47 | 0.39 | 16.9 | 3.8 | 10.0 |
| Example 70 | 0.38 | 0.58 | 0.50 | 0.55 | 16.8 | 4.0 | 10.5 |
| Example 71 | 0.38 | 0.52 | 0.52 | 0.42 | 17.2 | 4.0 | 10.6 |
| Example 72 | 0.40 | 0.56 | 0.50 | 0.41 | 17.0 | 4.0 | 10.0 |
| Example 73 | 0.40 | 0.56 | 0.46 | 0.39 | 18.3 | 4.2 | 10.5 |
| Example 74 | 0.41 | 0.53 | 0.48 | 0.40 | 18.4 | 4.5 | 11.0 |
| Example 75 | 0.42 | 0.55 | 0.47 | 0.41 | 18.2 | 4.5 | 10.7 |
| Example 76 | 0.42 | 0.57 | 0.50 | 0.51 | 18.4 | 4.7 | 11.2 |
| Example 77 | 0.44 | 0.59 | 0.49 | 0.53 | 18.0 | 5.0 | 11.4 |
| Example 78 | 0.48 | 0.58 | 0.52 | 0.48 | 17.6 | 5.0 | 10.4 |
| Example 79 | 0.46 | 0.58 | 0.50 | 0.47 | 18.5 | 4.8 | 10.4 |
| Example 80 | 0.48 | 0.52 | 0.51 | 0.49 | 19.0 | 5.0 | 10.4 |
| Example 81 | 0.48 | 0.56 | 0.53 | 0.56 | 19.1 | 5.0 | 10.4 |
| Example 82 | 0.42 | 0.32 | 1.35 | 0.59 | 16.0 | 4.0 | 9.5 |
| Example 83 | 0.37 | 0.85 | 1.88 | 1.32 | 21.8 | 3.4 | 9.2 |
| Example 84 | 0.40 | 0.52 | 0.45 | 1.48 | 22.6 | 4.2 | 10.5 |
| Example 85 | 0.38 | 0.60 | 0.12 | 0.42 | 17.6 | 4.0 | 10.5 |
| Example 86 | 0.35 | 0.61 | 0.53 | 0.44 | 18.3 | 3.2 | 9.1 |
| Example 87 | 0.36 | 0.50 | 0.42 | 0.43 | 17.6 | 3.6 | 10.0 |
| Example 88 | 0.37 | 0.51 | 0.43 | 0.45 | 17.4 | 3.7 | 10.0 |

TABLE 3-2

| No. | S | Al | 0.1Nb + Al | N | W | Mo | W + Mo |
|---|---|---|---|---|---|---|---|
| Example 43 | 0.137 | 0.010 | 0.33 | 0.07 | 0.8 | 0.0 | 0.8 |
| Example 44 | 0.138 | 0.019 | 0.34 | 0.08 | 0.0 | 0.8 | 0.8 |
| Example 45 | 0.140 | 0.024 | 0.34 | 0.06 | 1.0 | 0.0 | 1.0 |
| Example 46 | 0.142 | 0.011 | 0.34 | 0.09 | 1.2 | 0.2 | 1.4 |
| Example 47 | 0.152 | 0.013 | 0.34 | 0.06 | 1.0 | 0.2 | 1.2 |
| Example 48 | 0.149 | 0.030 | 0.35 | 0.07 | 1.5 | 0.0 | 1.5 |
| Example 49 | 0.152 | 0.045 | 0.37 | 0.08 | 1.5 | 0.0 | 1.5 |
| Example 50 | 0.146 | 0.066 | 0.39 | 0.09 | 2.0 | 0.0 | 2.0 |
| Example 51 | 0.140 | 0.075 | 0.40 | 0.08 | 2.1 | 0.0 | 2.1 |
| Example 52 | 0.151 | 0.022 | 0.35 | 0.08 | 2.0 | 0.2 | 2.2 |
| Example 53 | 0.147 | 0.031 | 0.37 | 0.07 | 2.2 | 0.2 | 2.4 |
| Example 54 | 0.153 | 0.044 | 0.38 | 0.06 | 2.3 | 0.2 | 2.5 |
| Example 55 | 0.152 | 0.058 | 0.40 | 0.08 | 2.0 | 0.0 | 2.0 |
| Example 56 | 0.148 | 0.012 | 0.37 | 0.09 | 2.1 | 0.0 | 2.1 |
| Example 57 | 0.149 | 0.025 | 0.39 | 0.08 | 2.0 | 0.0 | 2.0 |
| Example 58 | 0.142 | 0.033 | 0.39 | 0.06 | 2.2 | 0.0 | 2.2 |
| Example 59 | 0.140 | 0.043 | 0.40 | 0.07 | 2.1 | 0.0 | 2.1 |
| Example 60 | 0.146 | 0.056 | 0.42 | 0.08 | 2.1 | 0.0 | 2.1 |
| Example 61 | 0.144 | 0.062 | 0.42 | 0.08 | 2.0 | 0.0 | 2.0 |
| Example 62 | 0.153 | 0.079 | 0.44 | 0.08 | 2.0 | 0.0 | 2.0 |
| Example 63 | 0.149 | 0.028 | 0.40 | 0.08 | 2.0 | 0.1 | 2.1 |
| Example 64 | 0.142 | 0.070 | 0.44 | 0.07 | 2.1 | 0.1 | 2.2 |
| Example 65 | 0.148 | 0.022 | 0.40 | 0.06 | 2.3 | 0.0 | 2.3 |
| Example 66 | 0.147 | 0.034 | 0.42 | 0.07 | 2.2 | 0.0 | 2.2 |
| Example 67 | 0.151 | 0.042 | 0.42 | 0.08 | 2.4 | 0.0 | 2.4 |
| Example 68 | 0.155 | 0.058 | 0.44 | 0.09 | 2.5 | 0.0 | 2.5 |
| Example 69 | 0.149 | 0.067 | 0.45 | 0.08 | 2.5 | 0.0 | 2.5 |
| Example 70 | 0.152 | 0.026 | 0.43 | 0.09 | 2.2 | 0.0 | 2.2 |

TABLE 3-2-continued

| No. | S | Al | 0.1Nb + Al | N | W | Mo | W + Mo |
|---|---|---|---|---|---|---|---|
| Example 71 | 0.146 | 0.057 | 0.46 | 0.08 | 2.1 | 0.0 | 2.1 |
| Example 72 | 0.147 | 0.062 | 0.46 | 0.07 | 2.3 | 0.0 | 2.3 |
| Example 73 | 0.151 | 0.038 | 0.46 | 0.07 | 2.4 | 0.0 | 2.4 |
| Example 74 | 0.150 | 0.040 | 0.49 | 0.08 | 2.0 | 0.0 | 2.0 |
| Example 75 | 0.149 | 0.080 | 0.53 | 0.09 | 2.1 | 0.0 | 2.1 |
| Example 76 | 0.152 | 0.056 | 0.53 | 0.08 | 2.2 | 0.0 | 2.2 |
| Example 77 | 0.154 | 0.010 | 0.51 | 0.09 | 2.0 | 0.0 | 2.0 |
| Example 78 | 0.148 | 0.030 | 0.53 | 0.08 | 2.1 | 0.0 | 2.1 |
| Example 79 | 0.143 | 0.055 | 0.54 | 0.10 | 2.0 | 0.0 | 2.0 |
| Example 80 | 0.152 | 0.035 | 0.54 | 0.11 | 2.1 | 0.0 | 2.1 |
| Example 81 | 0.150 | 0.075 | 0.58 | 0.08 | 2.1 | 0.0 | 2.1 |
| Example 82 | 0.149 | 0.042 | 0.44 | 0.08 | 2.0 | 0.0 | 2.0 |
| Example 83 | 0.155 | 0.038 | 0.38 | 0.15 | 1.9 | 0.0 | 1.9 |
| Example 84 | 0.168 | 0.043 | 0.46 | 0.08 | 2.0 | 0.0 | 2.0 |
| Example 85 | 0.054 | 0.058 | 0.46 | 0.07 | 2.0 | 0.0 | 2.0 |
| Example 86 | 0.198 | 0.045 | 0.37 | 0.08 | 2.1 | 0.0 | 2.1 |
| Example 87 | 0.149 | 0.028 | 0.39 | 0.07 | 3.2 | 0.0 | 3.2 |
| Example 88 | 0.148 | 0.027 | 0.40 | 0.06 | 0.0 | 3.2 | 3.2 |

TABLE 3-3

| No. | Number of Sulfide Particles (/14000 μm$^2$) | Tool Life (minute) | Tool Life Improvement Ratio (times) | Room-Temperature Impact Strength (×10$^4$ J/m$^2$) |
|---|---|---|---|---|
| Example 43 | 23 | 75 | 1.21 | 11.2 |
| Example 44 | 31 | 76 | 1.23 | 11.5 |
| Example 45 | 32 | 76 | 1.23 | 11.3 |
| Example 46 | 22 | 75 | 1.21 | 12.1 |
| Example 47 | 21 | 75 | 1.21 | 12.0 |
| Example 48 | 37 | 85 | 1.37 | 12.3 |
| Example 49 | 48 | 86 | 1.39 | 12.2 |
| Example 50 | 33 | 83 | 1.34 | 11.2 |
| Example 51 | 31 | 79 | 1.27 | 10.5 |
| Example 52 | 34 | 82 | 1.32 | 12.3 |
| Example 53 | 36 | 88 | 1.42 | 12.4 |
| Example 54 | 50 | 94 | 1.52 | 12.1 |
| Example 55 | 38 | 89 | 1.44 | 12.5 |
| Example 56 | 24 | 78 | 1.26 | 12.7 |
| Example 57 | 32 | 83 | 1.34 | 11.9 |
| Example 58 | 39 | 89 | 1.44 | 12.2 |
| Example 59 | 54 | 98 | 1.58 | 12.5 |
| Example 60 | 39 | 92 | 1.48 | 12.6 |
| Example 61 | 34 | 83 | 1.34 | 12.3 |
| Example 62 | 31 | 78 | 1.26 | 12.0 |
| Example 63 | 33 | 83 | 1.34 | 12.3 |
| Example 64 | 31 | 81 | 1.31 | 12.1 |
| Example 65 | 31 | 82 | 1.32 | 12.5 |
| Example 66 | 38 | 92 | 1.48 | 12.3 |
| Example 67 | 54 | 102 | 1.65 | 12.2 |
| Example 68 | 36 | 90 | 1.45 | 12.4 |
| Example 69 | 33 | 83 | 1.34 | 12.1 |
| Example 70 | 33 | 82 | 1.32 | 12.0 |
| Example 71 | 38 | 88 | 1.42 | 12.5 |
| Example 72 | 34 | 83 | 1.34 | 12.3 |
| Example 73 | 41 | 87 | 1.40 | 12.4 |
| Example 74 | 45 | 84 | 1.35 | 11.8 |
| Example 75 | 31 | 78 | 1.26 | 10.2 |
| Example 76 | 38 | 81 | 1.31 | 11.5 |
| Example 77 | 21 | 78 | 1.26 | 10.2 |
| Example 78 | 36 | 82 | 1.32 | 10.6 |
| Example 79 | 40 | 76 | 1.23 | 10.8 |
| Example 80 | 41 | 75 | 1.21 | 11.3 |
| Example 81 | 33 | 75 | 1.21 | 10.6 |
| Example 82 | 50 | 94 | 1.52 | 11.1 |
| Example 83 | 47 | 93 | 1.50 | 10.2 |
| Example 84 | 44 | 88 | 1.42 | 10.3 |
| Example 85 | 36 | 87 | 1.40 | 12.3 |
| Example 86 | 46 | 84 | 1.35 | 11.7 |
| Example 87 | 33 | 81 | 1.31 | 10.2 |
| Example 88 | 34 | 82 | 1.32 | 10.0 |

TABLE 3-4

| No. | Weight Loss by Oxidation at 900° C. (mg/cm$^2$) | 0.2% Yield Strength at 900° C. (MPa) | Thermal Fatigue Life[(1)] (cycle) |
|---|---|---|---|
| Example 43 | 2 | 25 | 1495 |
| Example 44 | 3 | 25 | 1486 |
| Example 45 | 2 | 25 | 1473 |
| Example 46 | 1 | 26 | 1510 |
| Example 47 | 1 | 26 | 1518 |
| Example 48 | 1 | 27 | 1485 |
| Example 49 | 1 | 27 | 1509 |
| Example 50 | 1 | 26 | 1501 |
| Example 51 | 1 | 28 | 1502 |
| Example 52 | 1 | 28 | 1513 |
| Example 53 | 1 | 27 | 1507 |
| Example 54 | 1 | 30 | 1512 |
| Example 55 | 1 | 26 | 1503 |
| Example 56 | 1 | 29 | 1511 |
| Example 57 | 1 | 26 | 1522 |
| Example 58 | 1 | 30 | 1526 |
| Example 59 | 1 | 26 | 1515 |
| Example 60 | 1 | 26 | 1512 |
| Example 61 | 1 | 27 | 1508 |
| Example 62 | 1 | 29 | 1509 |
| Example 63 | 1 | 32 | 1517 |
| Example 64 | 1 | 31 | 1508 |
| Example 65 | 1 | 33 | 1553 |
| Example 66 | 1 | 33 | 1546 |
| Example 67 | 1 | 32 | 1532 |
| Example 68 | 1 | 33 | 1528 |
| Example 69 | 1 | 31 | 1519 |
| Example 70 | 1 | 34 | 1524 |
| Example 71 | 1 | 32 | 1520 |
| Example 72 | 1 | 33 | 1518 |
| Example 73 | 1 | 34 | 1527 |
| Example 74 | 1 | 34 | 1522 |
| Example 75 | 1 | 33 | 1514 |
| Example 76 | 1 | 34 | 1523 |
| Example 77 | 1 | 34 | 1509 |
| Example 78 | 1 | 35 | 1504 |
| Example 79 | 1 | 32 | 1515 |
| Example 80 | 1 | 34 | 1528 |
| Example 81 | 1 | 33 | 1517 |
| Example 82 | 12 | 30 | 1463 |
| Example 83 | 3 | 30 | 1510 |
| Example 84 | 1 | 31 | 1534 |
| Example 85 | 1 | 32 | 1516 |
| Example 86 | 1 | 29 | 1505 |
| Example 87 | 2 | 35 | 1565 |
| Example 88 | 2 | 34 | 1557 |

Note:
[(1)]At a constraint ratio of 0.5.

TABLE 4-1

| No. | C | Si | Mn | Ni | Cr | Nb | Nb/C |
|---|---|---|---|---|---|---|---|
| Com. Ex. 27 | 0.30 | 0.52 | 0.48 | 0.50 | 18.6 | 3.2 | 10.7 |
| Com. Ex. 28 | 0.49 | 0.63 | 0.52 | 0.41 | 16.9 | 4.8 | 9.8 |
| Com. Ex. 29 | 0.37 | 0.91 | 0.43 | 0.46 | 17.5 | 3.7 | 10.0 |
| Com. Ex. 30 | 0.36 | 0.60 | 0.09 | 0.57 | 17.3 | 3.4 | 9.4 |
| Com. Ex. 31 | 0.38 | 0.58 | 2.12 | 0.48 | 17.2 | 3.6 | 9.5 |
| Com. Ex. 32 | 0.38 | 0.53 | 0.47 | 0.31 | 19.5 | 3.9 | 10.3 |
| Com. Ex. 33 | 0.37 | 0.52 | 0.49 | 0.42 | 18.5 | 3.8 | 10.3 |
| Com. Ex. 34 | 0.38 | 0.51 | 0.47 | 1.68 | 18.4 | 3.7 | 9.7 |
| Com. Ex. 35 | 0.38 | 0.58 | 0.51 | 0.55 | 14.8 | 3.8 | 10.0 |
| Com. Ex. 36 | 0.39 | 0.51 | 0.53 | 0.54 | 25.8 | 3.8 | 9.7 |
| Com. Ex. 37 | 0.38 | 0.48 | 0.54 | 0.52 | 17.5 | 3.8 | 10.0 |
| Com. Ex. 38 | 0.33 | 0.53 | 0.48 | 0.63 | 18.1 | 3.0 | 9.1 |
| Com. Ex. 39 | 0.32 | 0.64 | 0.50 | 0.60 | 16.8 | 3.1 | 9.7 |
| Com. Ex. 40 | 0.32 | 0.62 | 0.49 | 0.58 | 17.1 | 3.0 | 9.4 |
| Com. Ex. 41 | 0.48 | 0.57 | 0.47 | 0.45 | 17.5 | 5.3 | 11.0 |
| Com. Ex. 42 | 0.47 | 0.50 | 0.55 | 0.47 | 17.4 | 5.2 | 11.1 |
| Com. Ex. 43 | 0.48 | 0.54 | 0.54 | 0.38 | 17.7 | 5.1 | 10.6 |
| Com. Ex. 44 | 0.44 | 0.56 | 0.52 | 0.41 | 18.0 | 3.8 | 8.6 |
| Com. Ex. 45 | 0.35 | 0.59 | 0.51 | 0.40 | 18.8 | 4.2 | 12.0 |
| Com. Ex. 46 | 0.32 | 0.58 | 0.50 | 0.68 | 19.8 | 3.2 | 10.0 |

TABLE 4-1-continued

| No. | C | Si | Mn | Ni | Cr | Nb | Nb/C |
|---|---|---|---|---|---|---|---|
| Com. Ex. 47 | 0.36 | 0.54 | 0.46 | 0.29 | 19.6 | 3.7 | 10.2 |
| Com. Ex. 48 | 0.38 | 0.53 | 0.50 | 0.64 | 19.7 | 3.8 | 10.0 |
| Com. Ex. 49 | 0.42 | 0.70 | 0.68 | 0.65 | 18.2 | 4.2 | 10.0 |
| Com. Ex. 50 | 0.36 | 0.65 | 0.48 | 0.50 | 17.3 | 3.4 | 9.4 |
| Com. Ex. 51 | 0.38 | 0.51 | 0.50 | 0.48 | 16.8 | 3.8 | 10.0 |
| Com. Ex. 52 | 0.42 | 0.52 | 0.49 | 0.43 | 17.0 | 4.2 | 10.0 |
| Com. Ex. 53 | 0.36 | 0.55 | 0.46 | 0.32 | 19.2 | 3.8 | 10.6 |
| Com. Ex. 54 | 0.35 | 0.48 | 0.40 | 0.44 | 17.5 | 3.6 | 10.3 |
| Com. Ex. 55 | 0.38 | 0.49 | 0.41 | 0.43 | 17.3 | 3.8 | 10.0 |

TABLE 4-2

| No. | S | Al | 0.1Nb + Al | N | W | Mo | W + Mo |
|---|---|---|---|---|---|---|---|
| Com. Ex. 27 | 0.143 | 0.018 | 0.34 | 0.08 | 2.0 | 0.1 | 2.1 |
| Com. Ex. 28 | 0.150 | 0.034 | 0.51 | 0.06 | 2.0 | 0.2 | 2.2 |
| Com. Ex. 29 | 0.145 | 0.020 | 0.39 | 0.06 | 2.3 | 0.0 | 2.3 |
| Com. Ex. 30 | 0.164 | 0.024 | 0.36 | 0.08 | 2.1 | 0.0 | 2.1 |
| Com. Ex. 31 | 0.162 | 0.028 | 0.39 | 0.08 | 2.0 | 0.0 | 2.0 |
| Com. Ex. 32 | 0.025 | 0.044 | 0.43 | 0.07 | 2.0 | 0.1 | 2.1 |
| Com. Ex. 33 | 0.236 | 0.015 | 0.40 | 0.08 | 2.2 | 0.1 | 2.3 |
| Com. Ex. 34 | 0.146 | 0.036 | 0.41 | 0.09 | 1.9 | 0.2 | 2.1 |
| Com. Ex. 35 | 0.148 | 0.068 | 0.45 | 0.09 | 2.0 | 0.2 | 2.2 |
| Com. Ex. 36 | 0.149 | 0.045 | 0.43 | 0.08 | 2.1 | 0.2 | 2.3 |
| Com. Ex. 37 | 0.156 | 0.025 | 0.41 | 0.21 | 2.0 | 0.2 | 2.2 |
| Com. Ex. 38 | 0.151 | 0.017 | 0.32 | 0.09 | 1.8 | 0.0 | 1.8 |
| Com. Ex. 39 | 0.152 | 0.048 | 0.36 | 0.08 | 1.9 | 0.0 | 1.9 |
| Com. Ex. 40 | 0.158 | 0.074 | 0.37 | 0.07 | 2.2 | 0.0 | 2.2 |
| Com. Ex. 41 | 0.154 | 0.014 | 0.54 | 0.08 | 2.3 | 0.0 | 2.3 |
| Com. Ex. 42 | 0.153 | 0.041 | 0.56 | 0.07 | 2.0 | 0.0 | 2.0 |
| Com. Ex. 43 | 0.147 | 0.076 | 0.59 | 0.09 | 2.2 | 0.0 | 2.2 |
| Com. Ex. 44 | 0.159 | 0.034 | 0.41 | 0.08 | 2.1 | 0.1 | 2.2 |
| Com. Ex. 45 | 0.141 | 0.025 | 0.45 | 0.07 | 2.0 | 0.1 | 2.1 |
| Com. Ex. 46 | 0.152 | 0.008 | 0.33 | 0.07 | 2.1 | 0.1 | 2.2 |
| Com. Ex. 47 | 0.141 | 0.003 | 0.37 | 0.08 | 2.2 | 0.1 | 2.3 |
| Com. Ex. 48 | 0.160 | 0.009 | 0.39 | 0.08 | 2.0 | 0.0 | 2.0 |
| Com. Ex. 49 | 0.152 | 0.009 | 0.43 | 0.08 | 2.1 | 0.0 | 2.1 |
| Com. Ex. 50 | 0.149 | 0.085 | 0.43 | 0.07 | 2.2 | 0.1 | 2.3 |
| Com. Ex. 51 | 0.145 | 0.087 | 0.47 | 0.07 | 2.1 | 0.1 | 2.2 |
| Com. Ex. 52 | 0.147 | 0.084 | 0.50 | 0.08 | 2.3 | 0.2 | 2.5 |
| Com. Ex. 53 | 0.008 | 0.004 | 0.38 | 0.06 | 2.0 | 0.0 | 2.0 |
| Com. Ex. 54 | 0.151 | 0.026 | 0.39 | 0.08 | 3.6 | 0.0 | 3.6 |
| Com. Ex. 55 | 0.148 | 0.025 | 0.41 | 0.07 | 0.0 | 3.5 | 3.5 |

TABLE 4-3

| No. | Number of Sulfide Particles (/14000 μm$^2$) | Tool Life (minute) | Tool Life Improvement Ratio (times) | Room-Temperature Impact Strength (×10$^4$ J/m$^2$) |
|---|---|---|---|---|
| Com. Ex. 27 | 23 | 70 | 1.13 | 5.8 |
| Com. Ex. 28 | 36 | 53 | 0.85 | 6.2 |
| Com. Ex. 29 | 30 | 81 | 1.31 | 5.2 |
| Com. Ex. 30 | 6 | 48 | 0.77 | 12.8 |
| Com. Ex. 31 | 34 | 82 | 1.32 | 8.4 |
| Com. Ex. 32 | 13 | 58 | 0.94 | 10.7 |
| Com. Ex. 33 | 28 | 79 | 1.27 | 7.2 |
| Com. Ex. 34 | 45 | 56 | 0.90 | 5.8 |
| Com. Ex. 35 | 32 | 62 | 1.00 | 11.6 |
| Com. Ex. 36 | 52 | 59 | 0.95 | 6.6 |
| Com. Ex. 37 | 31 | 57 | 0.92 | 3.5 |
| Com. Ex. 38 | 22 | 52 | 0.84 | 4.7 |
| Com. Ex. 39 | 43 | 60 | 0.97 | 3.9 |
| Com. Ex. 40 | 32 | 55 | 0.89 | 3.6 |
| Com. Ex. 41 | 20 | 53 | 0.85 | 6.9 |
| Com. Ex. 42 | 46 | 55 | 0.89 | 6.1 |
| Com. Ex. 43 | 32 | 49 | 0.79 | 4.8 |
| Com. Ex. 44 | 37 | 60 | 0.97 | 4.3 |
| Com. Ex. 45 | 32 | 81 | 1.31 | 6.5 |
| Com. Ex. 46 | 15 | 54 | 0.87 | 12.5 |
| Com. Ex. 47 | 12 | 62 | 1.00 | 12.3 |
| Com. Ex. 48 | 16 | 59 | 0.95 | 12.1 |

TABLE 4-3-continued

| No. | Number of Sulfide Particles (/14000 μm$^2$) | Tool Life (minute) | Tool Life Improvement Ratio (times) | Room-Temperature Impact Strength (×10$^4$ J/m$^2$) |
|---|---|---|---|---|
| Com. Ex. 49 | 18 | 61 | 0.98 | 12.3 |
| Com. Ex. 50 | 22 | 57 | 0.92 | 4.2 |
| Com. Ex. 51 | 20 | 56 | 0.90 | 3.8 |
| Com. Ex. 52 | 22 | 52 | 0.84 | 3.5 |
| Com. Ex. 53 | 5 | 55 | 0.89 | 12.5 |
| Com. Ex. 54 | 32 | 58 | 0.94 | 3.8 |
| Com. Ex. 55 | 35 | 57 | 0.92 | 3.4 |

TABLE 4-4

| No. | Weight Loss by Oxidation at 900° C. (mg/cm$^2$) | 0.2% Yield Strength at 900° C. (MPa) | Thermal Fatigue Life[(1)] (cycle) |
|---|---|---|---|
| Com. Ex. 27 | 2 | 16 | 1393 |
| Com. Ex. 28 | 1 | 22 | 1467 |
| Com. Ex. 29 | 1 | 23 | 1411 |
| Com. Ex. 30 | 1 | 24 | 1454 |
| Com. Ex. 31 | 28 | 22 | 1382 |
| Com. Ex. 32 | 1 | 35 | 1513 |
| Com. Ex. 33 | 2 | 28 | 1487 |
| Com. Ex. 34 | 1 | 25 | 1462 |
| Com. Ex. 35 | 87 | 24 | 1398 |
| Com. Ex. 36 | 1 | 23 | 1515 |
| Com. Ex. 37 | 3 | 22 | 1409 |
| Com. Ex. 38 | 4 | 17 | 1381 |
| Com. Ex. 39 | 2 | 18 | 1388 |
| Com. Ex. 40 | 2 | 18 | 1396 |
| Com. Ex. 41 | 4 | 27 | 1413 |
| Com. Ex. 42 | 3 | 25 | 1422 |
| Com. Ex. 43 | 3 | 26 | 1416 |
| Com. Ex. 44 | 3 | 22 | 1387 |
| Com. Ex. 45 | 1 | 25 | 1454 |
| Com. Ex. 46 | 3 | 30 | 1493 |
| Com. Ex. 47 | 2 | 33 | 1502 |
| Com. Ex. 48 | 1 | 31 | 1511 |
| Com. Ex. 49 | 1 | 34 | 1510 |
| Com. Ex. 50 | 1 | 21 | 1418 |
| Com. Ex. 51 | 1 | 22 | 1415 |
| Com. Ex. 52 | 1 | 24 | 1437 |
| Com. Ex. 53 | 2 | 32 | 1495 |
| Com. Ex. 54 | 1 | 38 | 1524 |
| Com. Ex. 55 | 1 | 40 | 1538 |

Note:
[(1)]At a constraint ratio of 0.5.

EFFECT OF THE INVENTION

Because the heat-resistant, cast ferritic steel of the present invention has good machinability while keeping excellent heat resistance characteristics at around 900° C., it can provide a tool with a long life when cut at a high speed, resulting in improved machining productivity and economic advantages. It is also advantageous in material cost reduction by reducing the amounts of rare metals used, and contributes to effective use and stable supply of raw materials. Further, because of no necessity of a heat treatment for improving machinability, the production cost can be reduced, contributing to reducing energy consumption. Using the heat-resistant, cast ferritic steel of the present invention with such features, exhaust members for automobiles can be efficiently produced at low cost, expanding an application range of fuel-efficiency-increasing technologies, contributing to reducing the emission of a $CO_2$ gas from automobiles, etc.

DESCRIPTION OF REFERENCES

1 . . . Ferrite phase
2 . . . Eutectic carbide (NbC)
3 . . . Sulfide particles

What is claimed is:

1. A heat-resistant, cast ferritic steel having excellent machinability comprising by mass 0.32-0.48% of C,
0.85% or less of Si,
0.1-2% of Mn,
1.5% or less of Ni,
16-23% of Cr,
3.2-5% of Nb,
Nb/C being 9-11.5,
0.15% or less of N,
0.05-0.2% of S, and
0.01-0.08% of Al,
the balance being Fe and inevitable impurities.

2. The heat-resistant, cast ferritic steel having excellent machinability according to claim 1, which further comprises 0.8-3.2% by mass in total of W and/or Mo.

3. The heat-resistant, cast ferritic steel according to claim 1, wherein Nb and Al meet the following formula:

$$0.35 \leq 0.1Nb + Al \leq 0.53 \quad (1),$$

wherein each element symbol represents its content (% by mass).

4. The heat-resistant, cast ferritic steel according to claim 1, which has a structure in which the number of sulfide particles per a field area of 14000 $\mu m^2$ is 20 or more.

5. An exhaust member formed by the heat-resistant, cast ferritic steel recited in claim 1.

* * * * *